United States Patent [19]

Yanagawa

[11] 4,204,668

[45] May 27, 1980

[54] PAPER FEEDING APPARATUS

[75] Inventor: Nobuyuki Yanagawa, Chigasaki, Japan

[73] Assignee: Ricoh Company, Ltd., Japan

[21] Appl. No.: 905,044

[22] Filed: May 11, 1978

[30] Foreign Application Priority Data

| | | | |
|---|---|---|---|
| May 17, 1977 | [JP] | Japan | 52-56564 |
| May 17, 1977 | [JP] | Japan | 52-56565 |
| May 24, 1977 | [JP] | Japan | 52-60303 |
| May 24, 1977 | [JP] | Japan | 52-60304 |

[51] Int. Cl.[2] ..... B65H 3/06

[52] U.S. Cl. ..... 271/9; 271/109; 271/145

[58] Field of Search ..... 271/8, 9, 109, 145

[56] References Cited

U.S. PATENT DOCUMENTS

| | | | |
|---|---|---|---|
| 3,598,396 | 8/1971 | Andrews | 271/9 |
| 3,817,515 | 6/1974 | Kanda | 271/9 |
| 3,871,640 | 3/1975 | Ritzerfeld | 271/9 |

*Primary Examiner*—Richard A. Schacher

*Attorney, Agent, or Firm*—McGlew and Tuttle

[57] ABSTRACT

A paper feeding apparatus includes respective feeders for a manually loaded paper and a cassette feeder, both of which are simultaneously operated by single paper feed control means, but the feeding of a manually loaded paper is disabled during a cassette feeding mode while the cassette feeder is disabled during a manually loaded paper feeding mode.

31 Claims, 29 Drawing Figures

PAPER FEEDING APPARATUS

BACKGROUND OF THE INVENTION

The invention relates to a paper feeding apparatus, and more particularly, to such apparatus capable of feeding both manually loaded papers and papers contained in a cassette.

A cassette feeder system is known as one of feeders utilized in the art of copying machines. This permits a series of sheets, cut to size, to be fed in succession, and provides copies of a given size, which is convenient for editing and binding purposes. A plurality of cassettes are provided in accordance with different sizes of the sheets, and are selectively loaded into the machine in accordance with the size of an original.

Considering some situations which occur when using a copying machine which is provided with a cassette feeder, it may be desired to obtain a copy of A4-size (210 mm×297 mm). If the cassette loaded into the machine is of the same size, there is no problem. However, if the paper size of the loaded cassette is different, it is necessary to change the cassette even though a single copy is desired. Also, it may sometimes be desired to obtain a single copy from a different original in the course of a succession of copying operations. If the cassette loaded is the same size as that for the desired copy, it is possible to interrupt the succession in order to obtain the single copy. However, if the paper size of the loaded cassette is different, the desired copy must be obtained by changing the cassette after the succession of copying operations have been completed, thus requiring a waste, waiting time.

To overcome the above difficulties, there is also provided a so-called multiple feeder mechanism which is provided with a plurality of cassettes of different paper sizes and which selectively supplies one of them. However, the use of such multiple feeder mechanism results in an increased overall dimension of the copying machine. Furthermore, the mutiple mechanism generally includes only two different sheet sizes, and if the loaded cassette is of a size which is different from that for a desired copy, the cassette must be changed even though the number of desired copies is only one.

The change of the cassette can be avoided by providing a paper feeding apparatus which includes a manually loaded paper feeder in addition to the cassette feeder so that a desired copy or copies can be obtained by utilizing the manual feeder mode. However, conventional paper feeding apparatus of this kind includes a cassette and a manually loaded paper feeder which operate independently from each other, resulting in a complex and bulky arrangement.

One form of paper feeding apparatus includes a feed roller which is disposed at a fixed position and below which a sheet cassette carrying a plurality of sheets is disposed. A baseplate in the cassette may be moved upwardly to bring an uppermost sheet into abutment against the roller in order to deliver that sheet. In the conventional arrangement, the baseplate is raised or lowered by a pusher member disposed in a cassette receiving portion of the copying machine, for example, and which is movable in the vertical direction to engage with or disengage from the baseplate, the pusher member being operated by an operating member which projects out of the copying machine. The sheet cassette cannot be removed unless the operating member has released the pusher member. However, in a paper feeding apparatus which is selectively capable of a cassette feeder operation employing the vertical movement of the bottom plate and of the feeding of a manually loaded paper, an inadvertent rise of the baseplate may result in feeding a sheet from the cassette when the feeding of manually loaded paper is desired. Additionally, an accidental rise of the pusher member or lever when the cassette is not loaded may result in the engagement of the lever with the feed roller, which is undesirable.

In a system employing the cassette feeder, a paper detector is usually disposed adjacent the loading position of the cassette in order to detect the presence or absence of a sheet or sheets in a cassette to disable each copying unit including the paper feeder if the absence of sheet is detected even though the cassette is properly loaded in position. The detector also disables the copying operation whenever the cassette is not properly loaded. A control of the copying operation in response to such detection is satisfactory in a paper feeding apparatus which is only capable of a cassette feeder operation. However, in a paper feeding apparatus which is designed to provide the feeding of a manually loaded paper as well, the detection of the presence or absence is insufficient, and it is also necessary to check the position or orientation of the manually loaded paper.

SUMMARY OF THE INVENTION

It is an object of the invention to provide a paper feeding apparatus which includes a manually loaded paper feeder and a cassette feeder, both of which are driven by a common drive mechanism in response to a single paper feed signal and under the control of single feed control means to thereby simplify the general arrangement, and in which the feeding of a manually loaded paper is given priority over the cassette feeder if the cassette is loaded in position whenever a manual feeder mode is established while the cassette feeder is enabled whenever the manual feeding is disabled.

It is another object of the invention to provide a paper feeding apparatus including a sheet cassette having a baseplate which is associated with a baseplate pusher mechanism which automatically pushes up the baseplate without requiring a manual intervention whenever the cassette is loaded and a cassette feeder mode is established.

It is a further object of the invention to provide a paper feeding apparatus in which a pusher lever associated with the baseplate of the sheet cassette is locked against oscillation whenever the cassette is not loaded or whenever the cassette is loaded but a manual feeder mode is established.

DETAILED DESCRIPTION OF PREFERRED EMBODIMENTS

Figure 1:
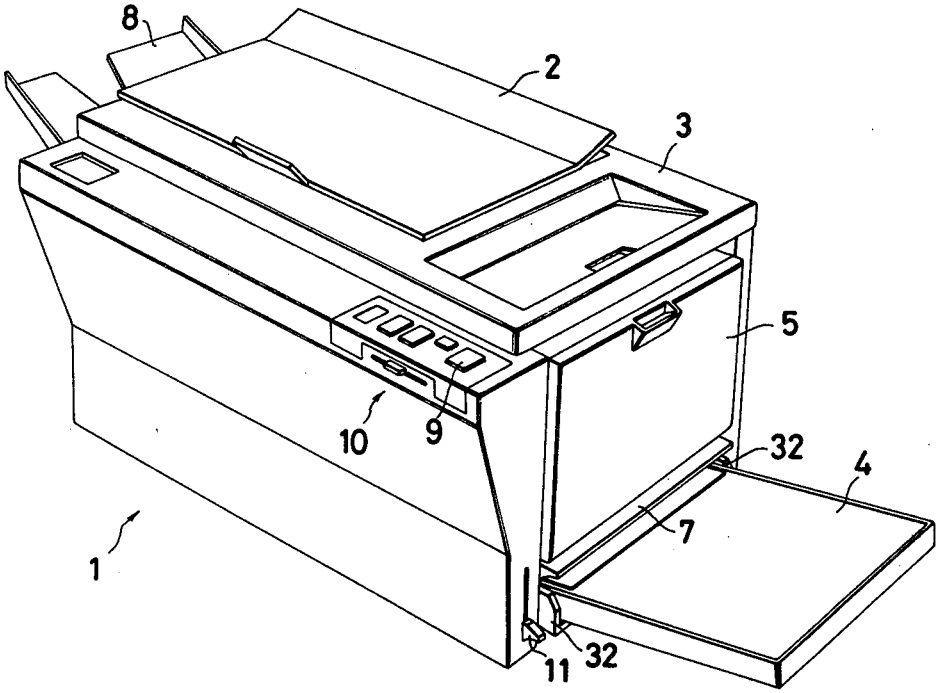
FIG. 1 is a perspective view of an exemplary copying machine including the paper feeding apparatus of the invention.
Figure 2:
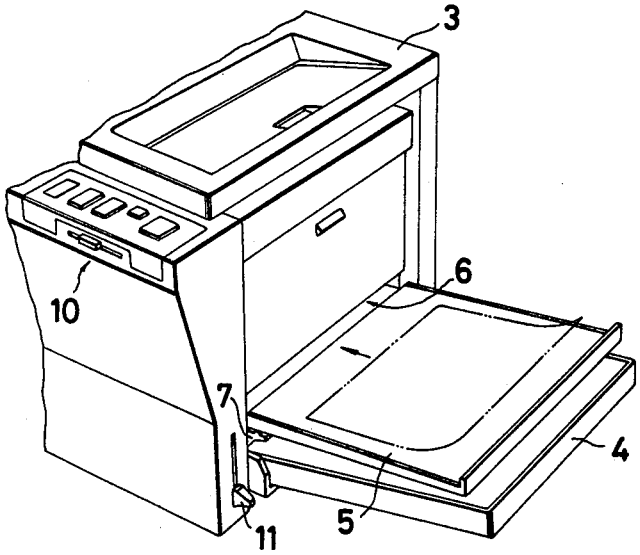
FIG. 2 is a fragmentary perspective view, illustrating the copying machine during a manual feeder mode.

Referring to FIG. 1 initially, there is shown an exemplary copying machine, generally shown by numeral 1, including the paper feeding apparatus of the invention. An original retainer 2 is shown on top of the machine 1 and can be closed against or removed from an original which is placed on a slider 3 which is disposed for reciprocating movement. A cassette 4 is shown as being detachably mounted into the machine in the right-hand bottom portion thereof. An end cover 5 is swingably mounted in the right-hand portion of the machine 1 and exposes a manual feed inlet 6 when it is open during a manual feeder mode, as shown in FIG. 2. In its open position, the cover 5 also serves as a sheet guide for the paper being fed. A stop 7 is located below the cover 5 and maintains it in the open position. A paper delivery table 8 is located at the left-hand end of the machine. An operation board 10 including a print button 9 is disposed on the front side of the machine. In addition, a knob is shown at 11 which is associated with a feed mode switching lever which selectively establishes a cassette feeder mode and a manual feeder mode.

Figure 3:
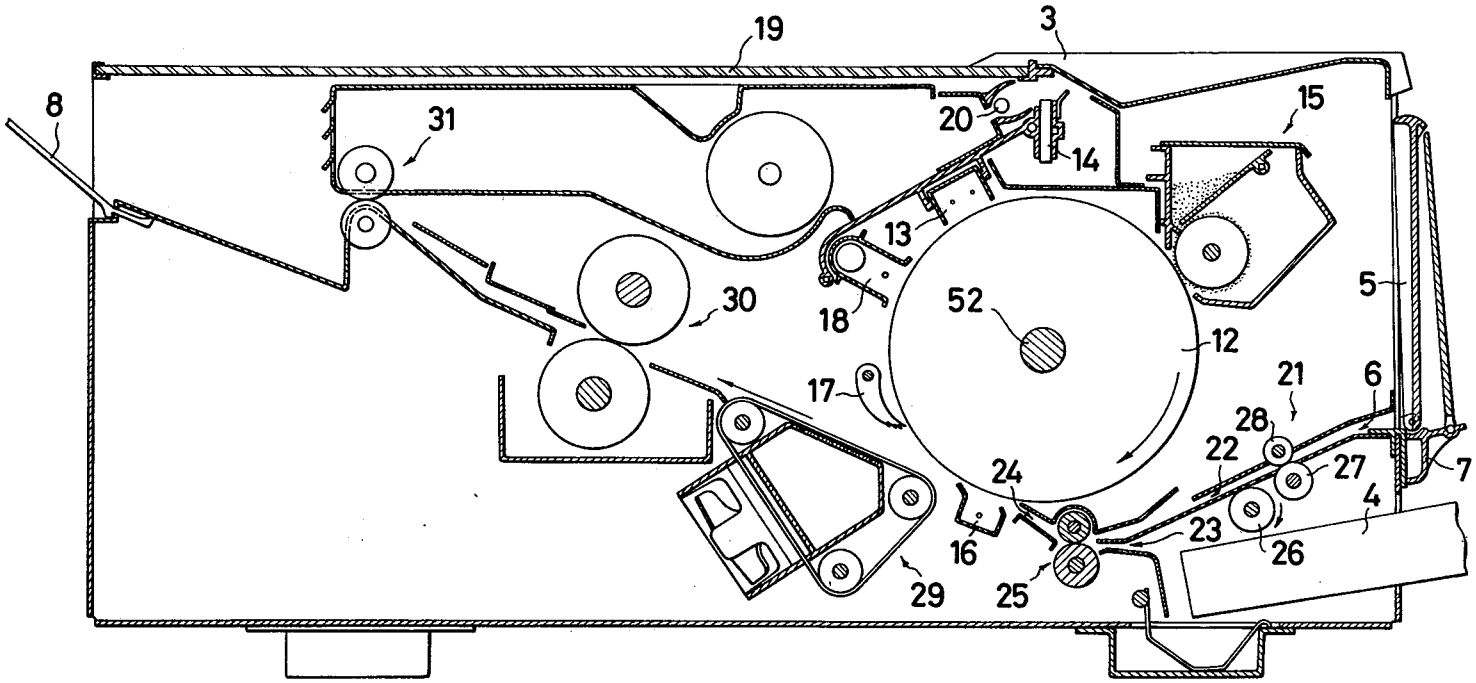
FIG. 3 is a schematic front view, partly in section, of the copying machine shown in FIG. 1.

Referring to FIG. 3, the internal construction of the copying machine will be described briefly. A photosensitive member 12 in the form of a drum is adapted to rotate in a direction indicated by an arrow. A plurality of functional units are disposed in sequence around the drum 12, including a main charger 13, an optical exposure system 14 employing a light focussing and transmitting member, a magnetic brush developer 15, a transfer charger 16, a sheet separator 17 and a neutralizer 18. A lamp 20 is disposed adjacent the optical system 14 to serve as a source of light which illuminates an original, not shown, placed on a contact glass plate 19 of the slider 3. A paper feeding apparatus 21 is disposed in the lower right-hand portion of the machine. The apparatus 21 includes a manual feed path 22, a cassette feed path 23, a common path 24, a pair of registering rollers 25 disposed at the junction of the paths 22, 23, a cassette feed roller 26 disposed above the cassette 4, a manual feed roller 27 partly extending into the path 22, an idler 28 disposed to be movable toward or away from the roller 27, and a drive mechanism for the parts described.

Assuming that the print button 9 is depressed, the drum 12 is set in motion, and its surface is charged by the charger 13. The slider 3 also begins to move so that when the leading edge of an image area on the drum 12 has reached a position directly below the optical system 14, the leading edge of an original placed on the contact glass plate 19 is located directly above the optical system 14. An image of the original illuminated by light from the lamp 20 is projected onto the drum surface by the system 14, thereby forming an electrostatic latent image. The latent image is converted into a toner image by the developer 15. Subsequently when the toner image has moved into a transfer station, a sheet fed from the apparatus 21 is brought into close contact with the drum surface, and the toner image is transferred from the drum surface onto the sheet by the action of the transfer charger 16. After the transfer is completed, the drum 12 continues to rotate under the neutralizer 18 to have any remaining potential eliminated, followed by a cleaning step. On the other hand, the sheet is separated from the drum surface by the separator 17, and is attracted toward a conveyor 29 and carried thereon in a direction indicated by an arrow. The sheet is then fed into a pressure fixing unit 30, which fixes the toner image. Subsequently, the sheet is passed between a pair of delivery roller 31 onto the delivery table 8. It will be appreciated that irrespective of whether a sheet fed into the transfer station is that from a cassette feeder or that from a manual feeder, it must be brought into complete alignment with an image forming area on the drum in order to assure a perfect transfer of the toner image. To this end, the pair of registering rollers 25 are provided. The roller pair 25 functions to temporarily maintain a sheet stationary whether it be fed by the cassette feed roller 26 or by the manual feed roller 27, and to feed it onto the drum 12 in timed relationship therewith. The rotation of the roller pair 25 is controlled by a signal supplied by means which controls the rotation of the feed rollers.

Figure 4:
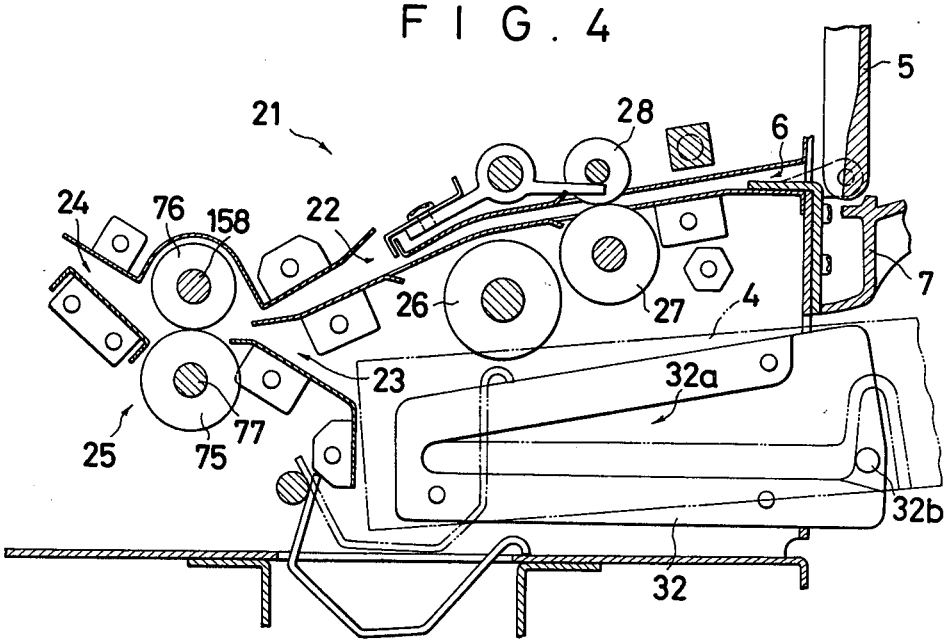
FIG. 4 is a schematic front view, partly in section, illustrating paper feed paths in the apparatus of the invention.
Figure 7:
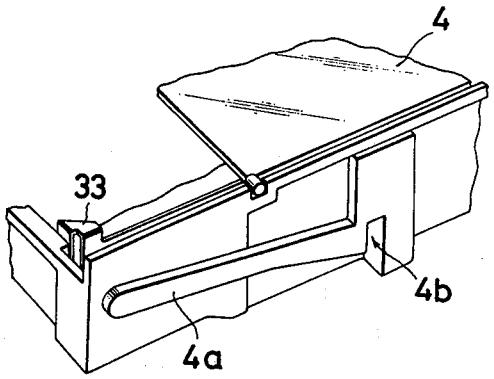
FIG. 7 is a perspective view showing part of the cassette.

Considering a cassette feeder initially, a cassette receiving portion of the machine fixedly includes a pair of cassette holders, only one being shown at 32 in FIGS. 4 to 6. The opposite sides of the holder 32 are formed with guide recesses 32*a* and stops 32*b* which are adapted to engage protuberances 4*a* and recesses 4*b* (see FIG. 7) which are located on both lateral sides of the cassette 4 adjacent the leading end thereof. A pair of corner separators 33 are disposed in the opposite corners of the cassette 4 at the leading end thereof for separating a sheet from a stack thereof, only one corner separator being shown in FIG. 7. A baseplate 34 (see FIG. 8) is disposed in the bottom region of the cassette 4 and is rockable with respect to the body of the cassette, a stack of sheets S being directly placed on the baseplate. The bottom of the cassette is formed with a slot 4*c* through which a pusher lever 35 extends to push up the baseplate 34 (see FIG. 8).

Figure 6:
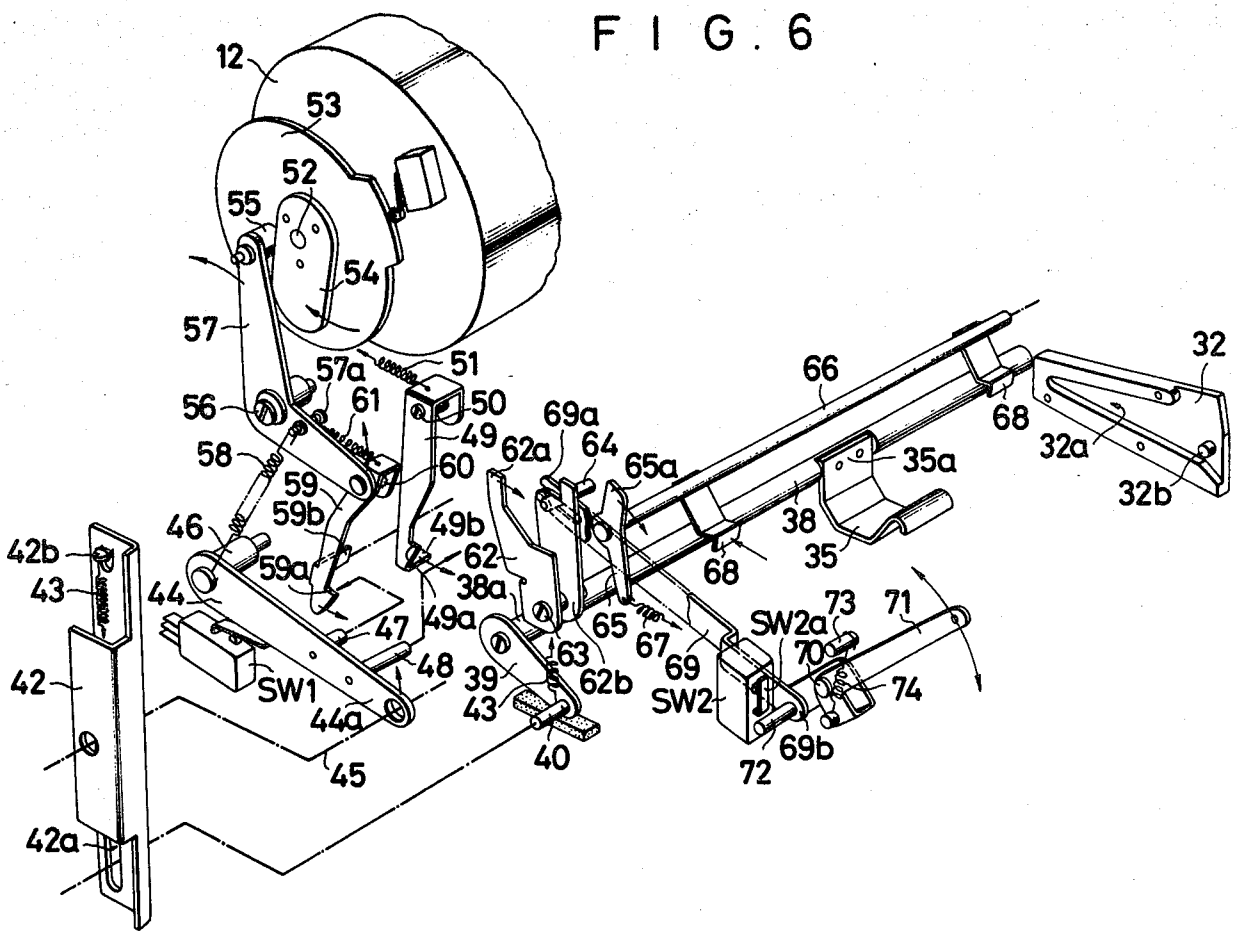
FIG. 6 is an exploded, perspective view of a baseplate pusher mechanism of a cassette feeder.

A baseplate pusher mechanism will now be described with reference to FIGS. 6, 8 and 9. The pusher lever 35 has its one end 35*a* fixedly mounted substantially on the center of a lever support shaft 38 which is in turn rotatably mounted in a pair of support plates 36, 37 (see FIG. 9). An end 38*a* of the shaft fixedly carries a lever 39, the free end of which is provided with a pin 40 which is fixedly mounted thereon. The pin 40 loosely fits in an elongate slot 42*a* formed in the lower end of a baseplate pusher link 42 which is disposed in vertical orientation along a side plate 41 (shown in only FIG. 9). A tension spring 43 extends between the pin 40 and a piece 42*b* projecting from the upper end of the link 42 for applying a pressure to the baseplate in an upward direction.

The link 42 carries a stub shaft 45 which is received in the free end 44*a* of a support lever 44 so as to be freely rotatable. The support lever 44 has its opposite end pivotally mounted on the side plate 41 by means of a support shaft 46. On its face toward the side plate 41, the support lever 44 fixedly carries a short pulling pin 47 and a long holding pin 48. A baseplate detecting switch SW1 is disposed below the lateral edge 44*b* of the support lever 44 toward said opposite end (see FIG. 8) for detecting the downward movement of the baseplate of the cassette. The lever 39, link 42, spring 43 and support lever 44 constitute together a baseplate pusher linkage.

The holding pin 48 on the support lever 44 is located adjacent the free end of a holding lever 49 which is in turn pivotally mounted on the side plate 41 by means of a support shaft 50 and has its free end urged by a spring 51 in a direction to bear against the pin 48. The free end of the holding lever 49 is formed with a step 49*a* engageable with and disengageable from the pin 48, and a bent tab 49*b* which is utilized to disengage the step from the pin 48.

The drum 12 is mounted on a support shaft 52 on which a timing cam 53 and an operating cam 54, which operates the pusher mechanism, are mounted in a substantially integral manner. A cam follower 55 is located on the path of rotation of the operating cam 54. The cam follower 55 is mounted on one end of a rockable lever 57 which is pivotally mounted on a pin 56 secured to the side plate 41. The lever 57 is urged by a spring 58 in a direction to urge the cam follower 55 into abutment against the operating cam 54. The other end of the lever 57 carries a pin 60 on which a pulling lever 59 is pivotally mounted, the free end of the lever 59 being located adjacent the pin 47. The free end of the lever 59 is formed with a step 59*a* which is capable of engaging with or disengaging from the pin 47, and a bent tab 59*b* which is utilized to disengage the step from the pin 47 and which allows the lever 59 to move freely in the vertical direction relative to the support lever 57 when the latter is in its up position. The detail of such operation will be described later. A tension spring 61 extends between the pivoted end of the lever 59 and a pin 57*a* fixedly mounted on the rockable lever 57 to urge the lever 59 in a direction to cause its free end to bear against the pin 47.

Figure 10:
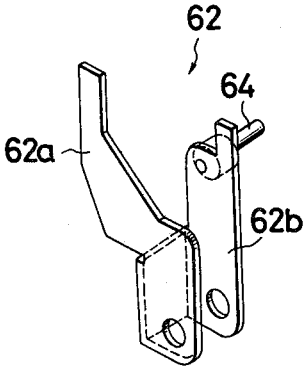
FIG. 10 is a perspective view of a control lever.
Figure 11:
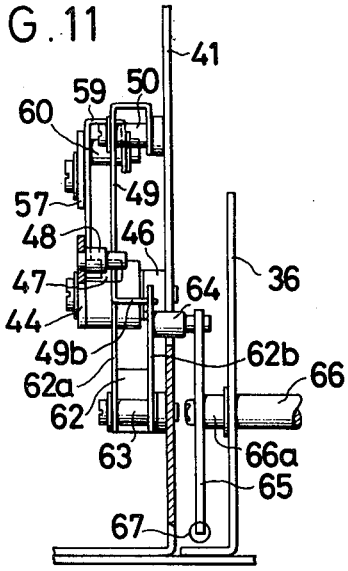
FIG. 11 is a side elevation illustrating the relationship between the control lever and other levers.

A control lever 62 is rotatably mounted on a support shaft 63 which is secured to the side plate 41, at a position below the holding lever 49 (see FIG. 11). As shown in FIG. 10, the control lever 62 includes a first arm 62*a*, a second arm 62*b* and a pin 64 fixedly mounted on the second arm 62*b*. As shown in FIG. 8, the first arm 62*a* is located intermediate the pin 47 and the free end of the pulling lever 59 while the second arm 62*b* is located so as to be engageable with the tab 49*b* of the holding lever 49. The pin 64 is located adjacent one end of a release lever 65, which operates to urge the lever 62 counterclockwise, as viewed in FIG. 8. The release lever 65 is fixedly mounted on one end 66*a* of a cassette detecting shaft 66 (FIG. 11) which is rotatably mounted on the pair of support plates 36, 37. The other end of the release lever 65 is engaged by one end of a spring 67, which urges it to drive the release lever 62 counterclockwise. The cassette detecting shaft 66 carries a pair of cassette detecting levers 68 which are substantially integral therewith. The levers 68 are positioned so that their free ends bear against the front end 4*d* (see FIG. 22) of the cassette when the latter is properly loaded in the copying machine. The levers 68 are urged by the spring 67 in a direction in which their free ends project into the cassette receiving portion of the copying machine.

The baseplate pusher lever 35, baseplate pusher linkage, pulling lever 59, holding lever 49, lever 57 and control lever 62 constitute together a baseplate pusher mechanism. The cassette detecting levers 68, release lever 65 and a link 69 to be secured below, constitute together a baseplate pressure control mechanism.

Figure 20:
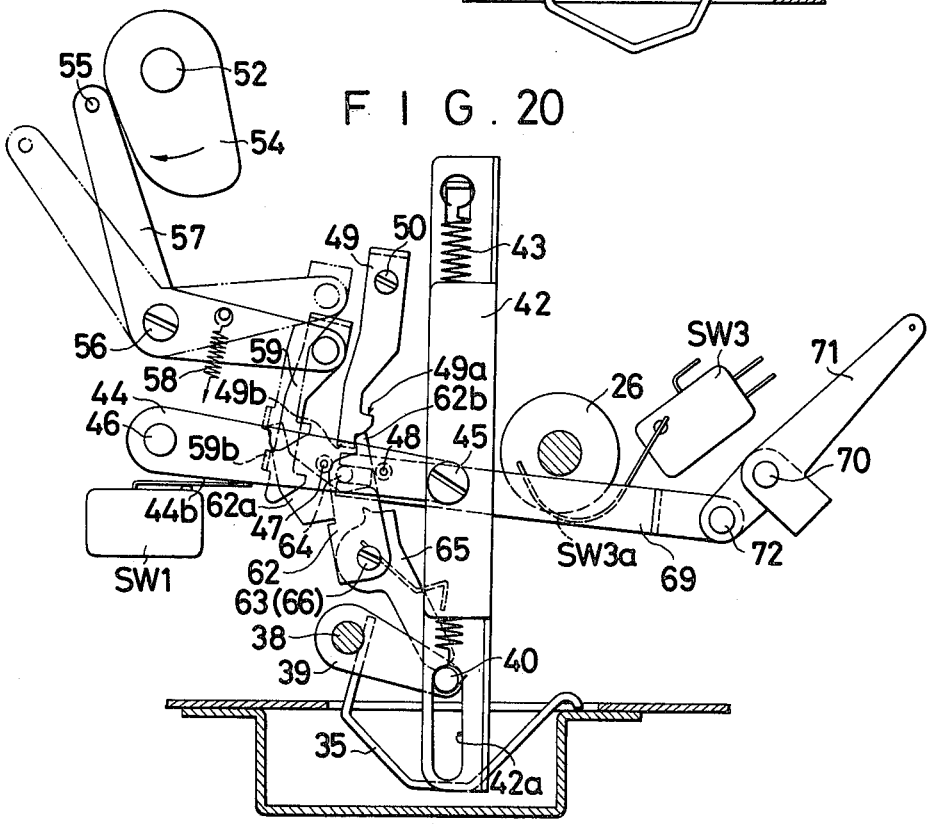
FIG. 20 is a front view of the pusher mechanism in its inoperative position.

The pin 64 on the control lever 62 is loosely engaged by a forked end 69*a* of the link 69, the other end 69*b* of which is pivotally mounted on one end of a feed mode switching lever 71 which is in turn pivotally mounted on a shaft 70 secured to the side plate 41. A shaft 72 provides a pivotal connection between the link 69 and the switching lever 71 and has its one end extending to operate the actuator SW2*a* of a manual feed detecting switch SW2 which is located on the path of rotation of the shaft 72 and which serves as a feed mode detecting switch. The switching lever 71 is engaged by one end of a spring 74, the other end of which is anchored to a pin 73 secured to the side plate, permitting the lever 71 to assume two positions corresponding to a cassette feed mode illustrated in solid line and a manual feed mode illustrated in phantom line in FIG. 8. The other end of the switching lever 71 projects outside the copying machine and fixedly carries the knob 11 (see FIGS. 1 and 2) thereon. The effect of the manual feed detecting switch SW2 has a priority over that of the switch SW1 and a baseplate detecting switch SW3 which will be described later. It is to be noted that the baseplate pusher mechanism is shown in FIG. 8 as when the cassette 4 is loaded with the baseplate 34 assuming its raised position while the same mechanism is shown in FIG. 20 when the cassette is not loaded. The operation of this mechanism will be described later.

Figure 12:
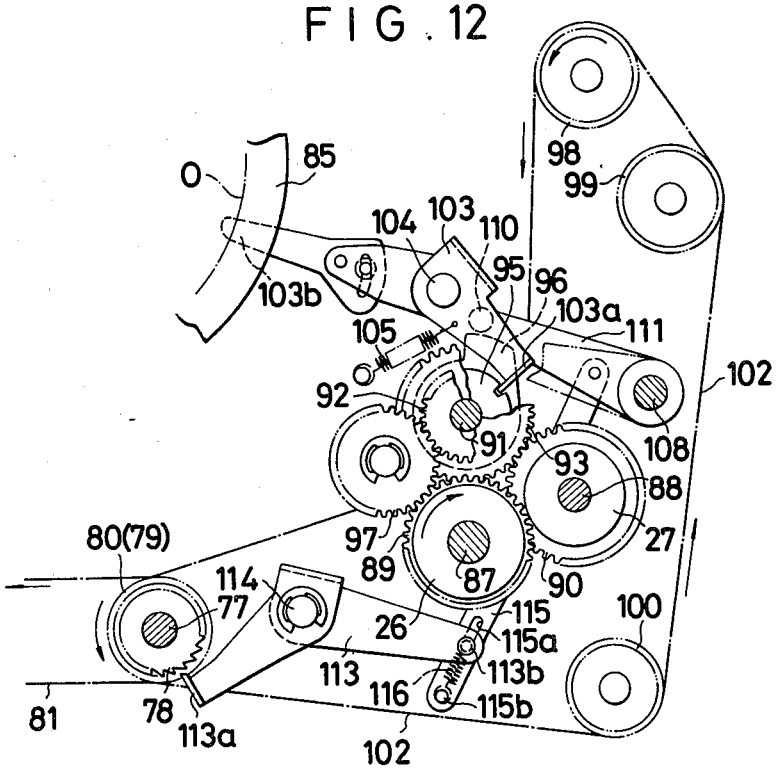
FIG. 12 is a front view of a drive mechanism used in the apparatus of the invention.
Figure 13:
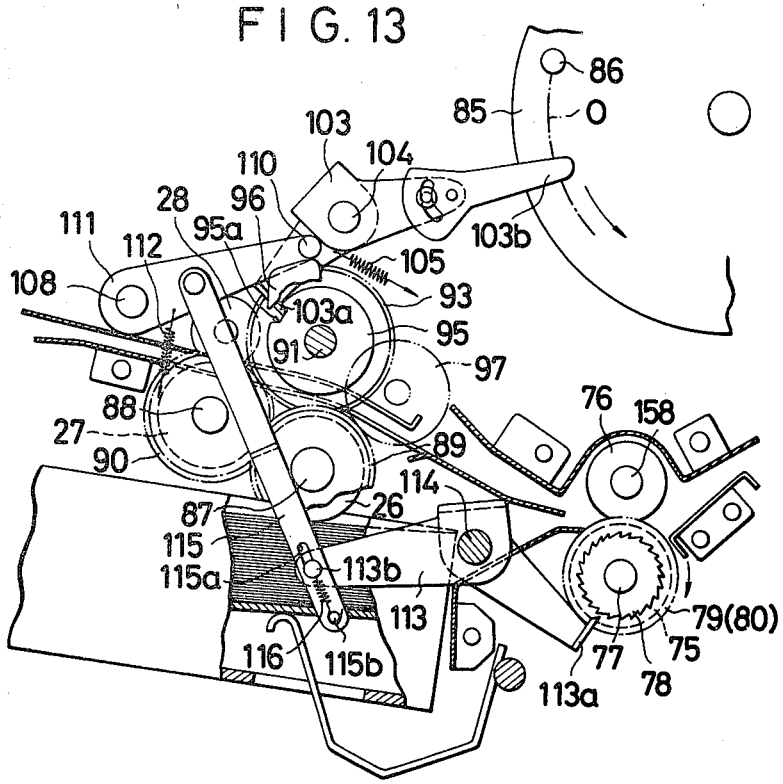
FIG. 13 is a rear view of the drive mechanism and feed control means.
Figure 14:
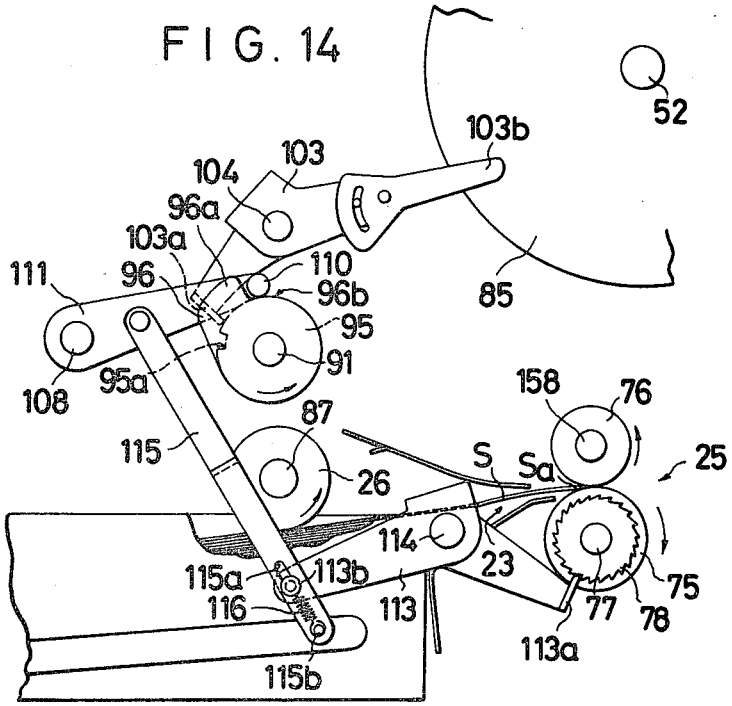
FIG. 14 is an illustration of the operation of the feed control means.
Figure 15:
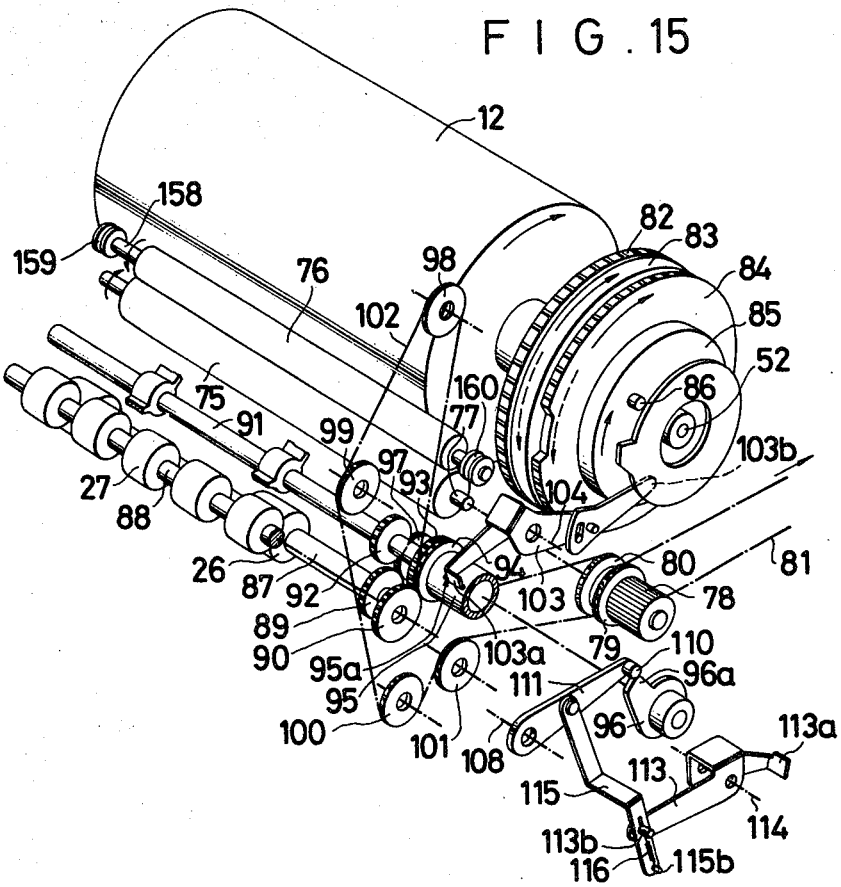
FIG. 15 is a fragmentary, exploded perspective view of the apparatus of the invention.

Referring to FIGS. 9, 12 to 15 and 29, a mechanism for controlling the rotation of the cassette feed roller, manual feed roller and registering rollers will be described. It is to be noted that, for convenience of description, a rear view of the mechanism is shown in FIGS. 13 to 15. The registering roller pair 25 comprises a drive registering roller 75 and an idler 76 which is driven by the roller 75. The registering roller 75 has its shaft 77 rotatably mounted in the side plates 41, 142 (see FIG. 9). One end 77*b* of the shaft extends through the side plate 142 and has mounted thereon a one-way clutch 78 and a pair of sprockets 79, 80 which are substantially integral with the clutch. A chain 81 (see FIG. 15) extends around the sprocket 79 and a drive source, not shown, causing the roller 75 to rotate in a direction indicated by an arrow. When the one-way clutch 78 is deactuated, the roller 75 ceases to rotate.

Considering the roller pair 25 more specifically, one end 77*a* of the shaft 77 is received in a bearing 150 mounted in an opening 41*a* which is formed in the side plate 41 while its other end 77*b* is received in a bearing 152 mounted in an opening 151*a* formed in a support plate 151 which is mounted so as to cover an opening 142*a*, formed in the side plate 142, from the outside. The purpose of the opening 142*a* is to permit the removal of the roller pair 25. A sleeve 153 having sprockets 79, 80 and one-way clutch 78 mounted thereon is fitted over the end 77*b* of the shaft 77. The sprockets 79, 80 are substantially integral with the sleeve 153. The one-way clutch 78 represents a spring clutch of a known form, and comprises the sleeve 153 which is rotatable on the shaft 77, a sleeve 154 secured to the shaft 77, a spring 155 disposed between these sleeves, and a sleeve 78*a* in the form of a ratchet wheel having one end of the spring anchored thereto. The support plate 151 is detachably secured to the side plate 142 by set screws 156, 157.

The idler 76 is disposed above the roller 75 and has a shaft 158, one end 158*a* of which is received in a grooved bearing 159 mounted in an elongate opening 41*b* formed in the side plate 41 and the other end of which is received in a grooved bearing 160 mounted in an elongate opening 151*b* formed in the support plate 151, whereby the idler 76 is rotatably mounted in the side plates 41, 142. A coiled spring 163, having its opposite ends anchored to a pair of pins 161, 162 which are secured to the side plate 41, extends around the grooved bearing 159 while a coiled spring 166, having its opposite ends anchored to a pair of pins 164, 165 which are secured to the side plate 142, extends around the grooved bearing 160, whereby the idler 76 is urged into abutment against the registering roller 75. The roller pair 25 can be easily removed out of the machine as when a jamming occurs, but its removal will be described later.

Referring to FIG. 15, mounted on one end of the shaft 52 of the drum 12 are a drum drive gear 82, a wire drum 83 which drives the slider 3 (see FIG. 1), a gear 84 which returns the slider, and a slider timing drum 85. The drum 85 fixedly carries a pin 86 which serves as a source of a feed start signal. It is to be understood that the gear 82 drives the drum 12 to rotate it through two revolutions for one cycle of copying operation, whereupon it comes to a stop. The wire drum 83 and gear 84 rotate in the same direction during the first revolution of the drum 12, but rotate in the opposite direction, indicated by a broken line arrow, during the second revolution of the drum 12 to stop at its start position. The timing drum 85 rotates integrally with the drum 12 during its first revolution, but remains stationary at its start position during the second revolution thereof.

The cassette feed rollers 26 and manual feed rollers 27 have their shafts 87, 88 rotatably mounted in the support plates 36, 37. A gear 89 is fixedly mounted on one end of the shaft 87. A gear 90 is fixedly mounted on an end of the shaft 88 which projects outside the side plate 142. It is to be understood that the feed rollers 26, 27 are connected with their associated shafts through respective one-way clutches, not shown. A stop support shaft 91 is rotatably mounted in the side plates 41, 142, and mounted on this shaft adjacent its one end, are a cassette feed roller drive gear 92, a manual feed roller drive gear 93, both of which are fixedly mounted thereon, as well as a drive sprocket 94 and a one-revolution clutch 95 which is operatively connected or disconnected from the support shaft 91. A cam 96 is fixedly mounted on the end of the clutch 95 for controlling the rotation of the registering roller and the feed operation by the manual feed roller. The combination of the clutch 95 and cam 96 controls the feed operation of both manual and cassette feeders. The gear 89 on the shaft 87 associated with the cassette feed roller 26 and the drive gear 92 are interconnected through an idler 97 rotatably mounted on the side plate 142 for free rotation. The gear 90 mounted on the shaft 88 associated with the manual feed roller 27 meshes with the drive gear 93. A chain 102 extends around the sprocket 94, idle sprockets 98, 99, 100 and tension sprocket 101 for transmitting the rotation of a sprocket 80 which is connected with a drive source.

An end 103*a* of a detecting lever 103 is engageable with and disengageable from the one-revolution clutch 95. The lever 103 is rotatably mounted on a shaft 104 secured to the side plate 142 is urged by a spring 105 (see FIGS. 12 and 13) into engagement with the clutch. The detecting lever 103 has its other ends 103*b* located on the path 0 of rotation of the pin 86 on the timing drum 85.

Figure 16:
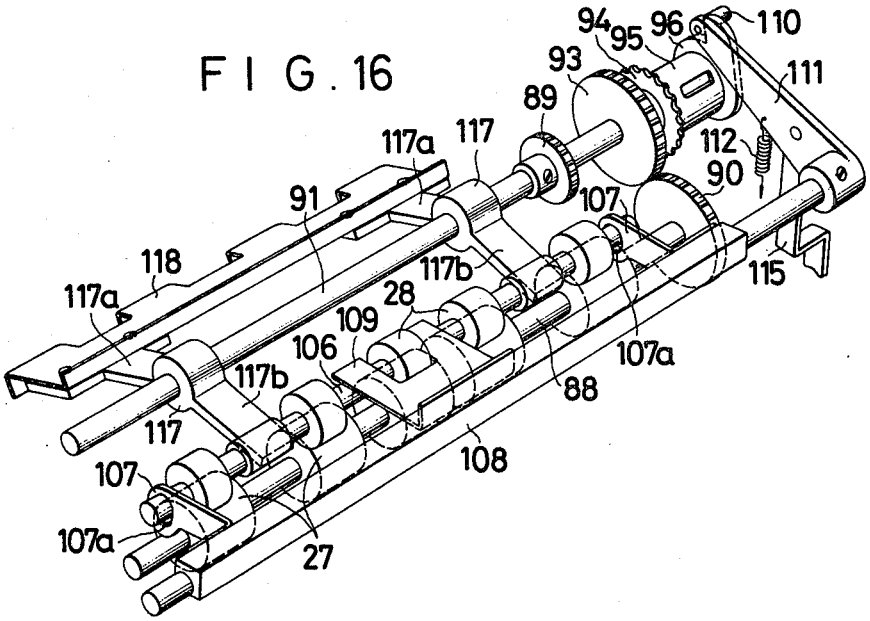
FIG. 16 is a fragmentary perspective view of the manual feeder.

Referring to FIGS. 9 and 16 to 18, the manual feed mechanism will be described. The idlers 28 are disposed above the manual feed rollers 27 and are movable into engagement with or disengagement from the latter. The idlers 28 are fixedly mounted on a shaft 106 which is in turn journaled at its opposite ends in elongate slots 107*a* formed in a pair of arms 107 so as to be vertically movable and rotatable (see FIG. 16). The pair of arms 107 have first ends fixedly mounted on a support shaft 108 which is rotatably mounted in the side plates 41, 142. As shown in FIG. 16, a leaf spring 109 is secured to the central portion of the support shaft 108 to urge the shaft 106 in a direction to drive the idlers 28 downwardly or to cause them to bear against the manaul feed rollers 27 within an extent permitted by the dimension of the slots 107*a*. The support shaft 108 has an end 108*a* on which is fixedly mounted a lever 111 carrying a cam follower 110 on its free end. The lever 111 is urged by a spring 112 in a direction to cause the cam follower 110 into abutment against the cam 96, or to force the idlers 28 against the feed roller 27 (see FIGS. 13 and 16).

A detent lever 113 is pivotally mounted on a stud 114 which is secured to the side plate 142 (see FIG. 9) so as to be engageable with and disengageable from the one-way clutch 78 which controls the rotation of the registering roller 75. The detent lever 113 has an end 113*a* which is located adjacent and below the clutch 78 (see FIGS. 12 and 13). The detent lever 113 and the lever 111 are interconnected by a link 115 as shown in FIGS. 13 15. The levers 111, 113 and link 115 form together a linkage. The detent lever 113 and link 115 are connected together by a combination of an elongate slot 115*a* and a headed pin 113*b*, with a spring 116 extending between the pin 113*b* and another pin 115*b* fixedly mounted on the link.

Figure 17:
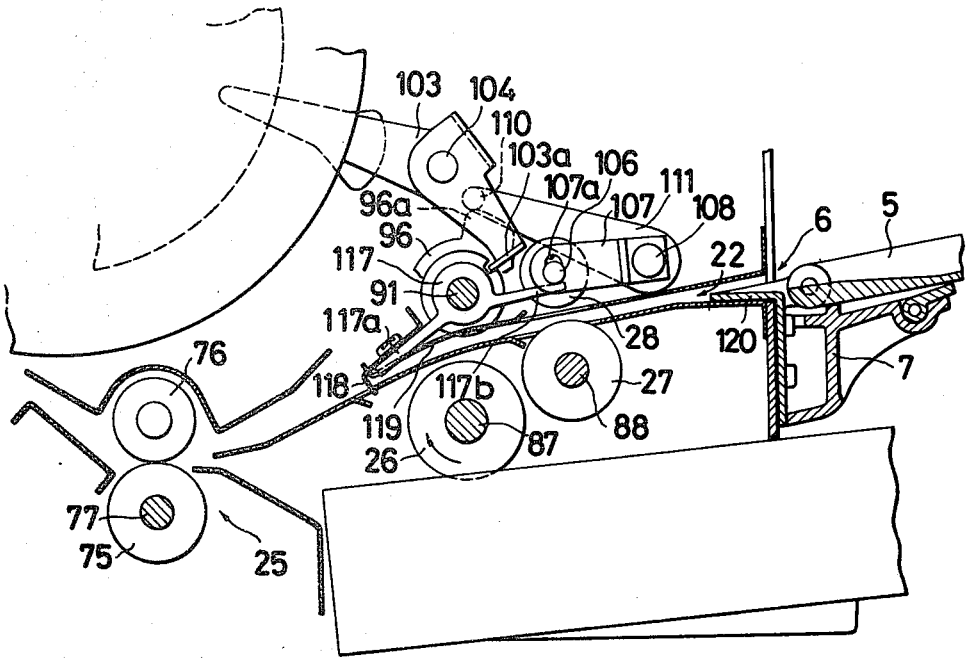
FIG. 17 is a front view of the manual feeder as it appears before initiating its operation.
Figure 19:
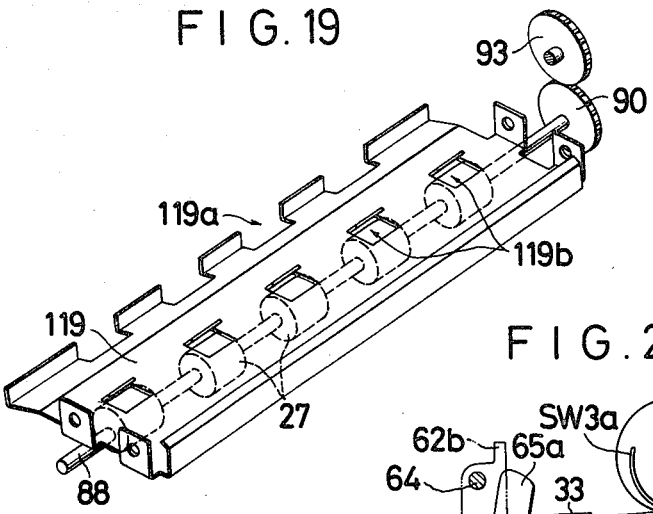
FIG. 19 is a perspective view showing the positional relationship between the manual feed roller and a guide member.

As indicated in FIG. 16, a pair of stop supports 117 are rotatably fitted on the stop support shaft 91 on which the one-revolution clutch 95 is mounted, and their thrustwise movement is limited. One end 117*a* of each support 117 is fixedly connected with a sheet stop 118 having a bent edge. By the weight of the sheet stop 118, the supports 117 are urged to rotate counterclockwise about the shaft 91, as viwed in FIG. 17, or in a direction to urge the stop 118 into the path 22 of a sheet being manually loaded so as to intercept it. The other end 117*b* of each stop support 117 engages the shaft 106 of the idlers 28 from below (see FIGS. 16 and 17). The free end or edge of the sheet stop 118 is intermittently recessed in interdigitated manner with interrupted edges 119*a* (see FIG. 19) of an upper guide member 19 which defines the path 22 (see FIG. 17). It will be seen that slots 119*b* are formed in the guide member 119 to permit an access of the idlers 28 therethrough. It will be noted that the manual feed rollers 27 partly extend into the path 22. As indicated in FIG. 17, the cover 5 (see FIG. 2) which serves as a sheet guide during a manual feed mode has its one end pivotally mounted on a support member 120 at a location adjacent the manual feed inlet 6, and is maintained in its open position by stop 7 during the manual feed mode.

Figure 22:
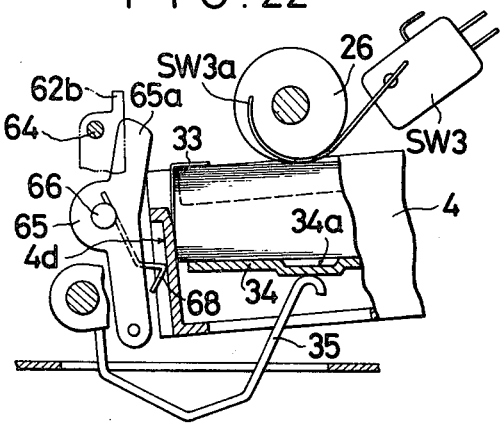
FIG. 22 is a front view, partly in section, showing the relationship between the cassette and a cassette detecting lever.

As indicated in FIGS. 20 and 22, a switch SW3 is disposed adjacent the cassette feed roller 26 for detecting the presence or absence of a sheet of paper. The switch SW3 has its actuator SW3*a* located slightly below the underside of the cassette feed roller 26 as shown in FIG. 20 when the cassette is not loaded. In other words, when the cassette 4 is loaded (see FIG. 22), the uppermost sheet bears against the actuator SW3*a* to operate the switch. The switch SW3 is disabled whenever the baseplate down detection switch SW1 has detected the down position of the baseplate, but is enabled to produce a signal indicative of the presence or absence of a sheet of paper only in the up position of the baseplate of the cassette. The operation of such detection mechanism will be described later.

The operation of the paper feeding apparatus of the invention will now be dealt with more specifically. Considering the cassette feed mode initially, FIG. 20 shows part of the copying machine when the cassette is not loaded. Control lever 62 is rotated counterclockwise about the shaft 63 as a result of its pin 64 being urged by one end 65*a* of the release lever 65 (see FIG. 21). As a consequence of the rocking motion of the control lever 62, the first arm 62*a* engages the tab 95*b* of the pulling lever 59 and the second arm 62*b* engages the tab 49*b* of the holding lever 49, thus rocking and maintaining the levers 59, 49 against their bias. The baseplate pusher link 42 moves down by its own weight to oscillate the lever 39. The oscillation of the lever 39 is transmitted through the support shaft 38 to move the pusher lever 35 to its down position. The support lever 44 is also rocked by the link 42, with its lower edge actuating the baseplate down detecting switch SW1. In response to the down position of the support lever 44 or the downward movement of the pusher lever 35, the detecting switch SW1 disables a copying operation, as by rendering the print button inoperative. However, during a manual feed mode, switch SW2 (see FIG. 8) is actuated in preference to the switch SW1. The switch SW3 does not produce a signal indicative of the absence of a sheet of paper even though there is no such sheet, since the switch SW1 has already produced a signal indicative of the down position of the baseplate.

Figure 5:
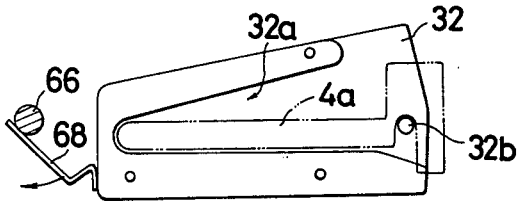
FIG. 5 is a front view of a cassette holder.

Under the condition shown in FIG. 20, if the cassette 4 is loaded into the cassette holder 32 (see FIGS. 5 and 6), the front plate 4*d* of the cassette bears against the cassette detecting lever 68 to rock it clockwise. In response thereto, the release lever 65 on the support shaft 66 also rocks in the same direction, releasing its drive upon the control lever 62. When the control lever 62 is freed, the bias applied to the pulling lever 59 and holding lever 49 causes them to move to respective positions in which they are engageable with pins 47, 48 on the support lever 44, respectively. Such positions of both levers are defined by the abutment of pin 64 on the control lever 62 against the bottom side of the forked end 69*a* of the link 69 which assumes its cassette feed mode position.

When the cassette contains sheets, the switch SW3 produces a signal indicating the presence of sheets, whereby the depression of the print button is effective to set the drum 12 in motion. The operating cam 54 which is substantially integral with the drum also rotates from its start position shown in solid line in FIG. 8, and when it reaches an operative position shown in phantom line, the cam surface thereon forces the cam follower 55 from its phantom line to its solid line position. In response thereto, the rockable lever 57 moves from its phantom line to its solid line position, pulling the pulling lever 59 which is pivotally connected with one end thereof. When the pulling lever 59 is raised, the step 59*a* is in engagement with the pin 47 to rock the support lever 44 counterclockwise about the shaft 46 to raise the free end 44*a* thereof as shown in FIG. 8. As indicated in FIG. 8, the lever 44 is maintained in its raised position by the engagement between the pin 48 and the step 49*a*. As the support lever 44 is raised, the baseplate pusher link 42 is raised. The upward movement of the pusher link 42 acts through spring 43 to rock the lever 39 counterclockwise resiliently, thus rocking its integral pusher lever 35 in the counterclockwise direction through the lever and support shaft 38 to thereby raise the baseplate 34. As the baseplate 34 is raised, the uppermost sheet is brought into abutment against the cassette feed roller 26 (see FIG. 8). The pusher lever 35 continues to push up the baseplate 34 under the resilience of the spring 43 even if the number of sheets within the cassette decreases as they are fed sequentially therefrom. It will be seen that there is no need for manual intervention to raise the baseplate of the cassette.

Referring to FIGS. 12 to 15, the feed control means associated with the cassette feed roller and means for controlling the rotation of the registering roller will now be described. It should be understood that the feed control means also controls the manual feed roller. FIGS. 12, 13 and 15 illustrate the start positions of these control means. Registering roller 75 is driven for rotation in the indicated direction by sprocket 79 which is connected by chain 81 with a drive source, not shown. The cassette feed roller 26 remains stationary since the one-revolution clutch 95 is deactuated or locked by the detecting lever 103. Since the clutch 95 remains stationary, the cam 96 also remains stationary in a position in which a portion 96*a* thereof having an increased diameter (see FIG. 15) is engaged by the cam follower 110 mounted on the lever 111. This rocks the lever 111 against its bias and also rocks the detent lever 113 through link 115, with the end 113*a* removed from the one-way clutch 78.

When the print button is depressed to initiate the rotation of the drum 12 (see FIG. 15), the timing drum 85 rotates, thereby bringing the pin 86 fixedly mounted thereon into engagement with the end 103*b* of the detecting lever 103. As the detecting lever 103 oscillates, the end 103*a* is disengaged from the recess 95*a* formed in the one-revolution clutch 95 (see FIG. 14), so that the rotation of the sprocket 94 which is connected with a drive source is transmitted to the support shaft 91. The resulting rotation of the support shaft 91 is transmitted through its integral gear 92 and idler 97 to the gear 89 mounted on the shaft 87 associated with the cassette feed roller 26, thus rotating the roller 26 in the indicated direction (see FIG. 14).

After having disengaged from the recess in the clutch 95, the detent end 103*a* of the detecting lever 103 is maintained in abutment against the peripheral surface of the clutch under its own bias, and drops into the recess 95*a* again after one revolution of the clutch, thus rocking it. As a result, upon completion of one revolution of the clutch 95, the transmission of the rotation to the feed roller 26 is interrupted. It is to be noted that, by the time the feed roller 26 is stopped, the uppermost sheet S in the cassette 4 is separated from the remainder and is fed into the path 23 with its leading edge Sa abutting against the roller pair 25, which then remains stationary as will be further described later (see FIG. 14). It will be appreciated that this sheet will be slightly flexed during such abutment.

On the other hand, when the clutch 95 is released, the cam 96 is set in motion. As the cam 96 rotates, the cam follower 110 now falls from the portion 96*a* to another portion 96*b* of a reduced diameter (see FIG. 14), causing a rocking motion of the lever 111, link 115 and detent lever 113, which constitute together a linkage. The rocking motion of the detent lever 113 brings its end 113*a* into engagement with the one-way clutch 78, bringing the roller pair 25 which has been rotating to a stop. The roller pair 25 is stopped before the leading edge Sa of the uppermost sheet fed by the cassette feed roller 26 reaches such pair. The roller pair 25 remains stationary for a duration which is determined by the length of time during which the cam follower 110 remains abutting against the portion 96*b* of the cam 96. When the cam follower 110 again engages the portion 96*a* to cause a rocking motion of the linkage, the detent end 113*a* of the detent lever 113 is disengaged from the one-way clutch 78, allowing the roller pair to rotate. The timing at which the roller pair 25 again begins to rotate is determined by the angular position of the cam 96 so that the leading end of the sheet is aligned with the leading end of the image forming area on the drum 12 in the transfer position. Since the trailing end of the sheet which has its leading end abutting against the roller pair 25 is retained by the feed roller while in its slightly flexed position, the rigidity of the sheet is sufficient to urge it toward the nip between the roller pair when rotating.

Figure 8:
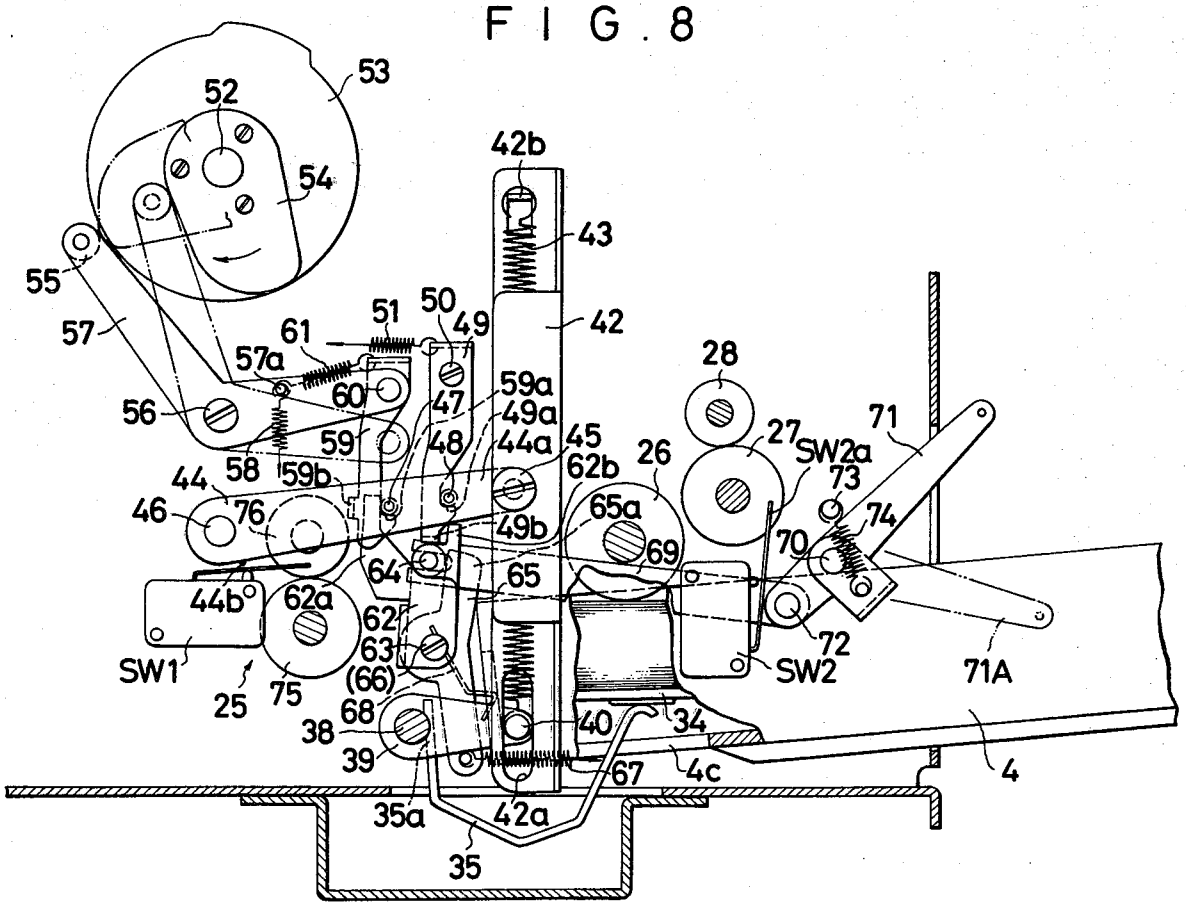
FIG. 8 is a front view of the baseplate pusher mechanism.
Figure 9:
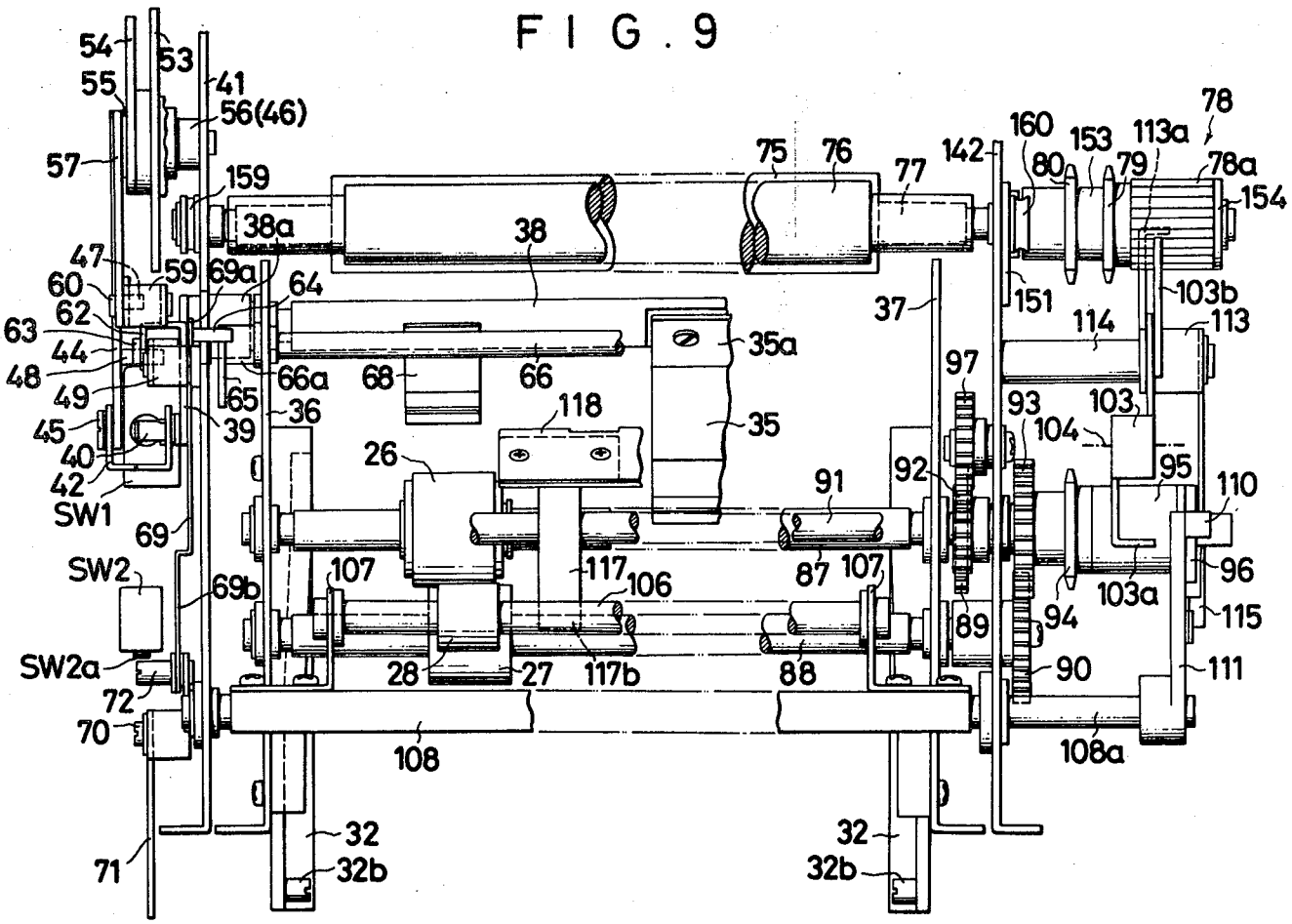
FIG. 9 is a fragmentary plan view of the apparatus of the invention.
Figure 23:
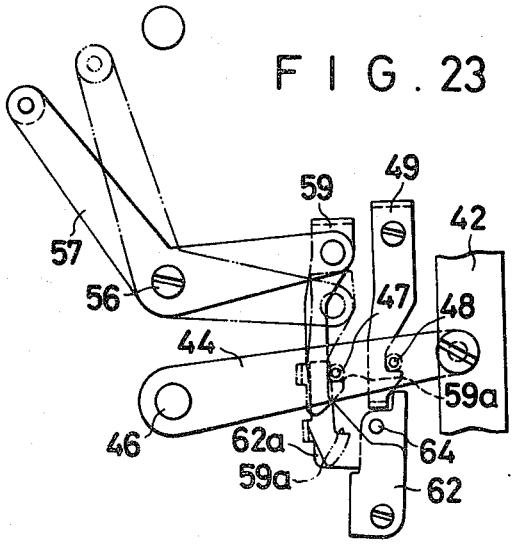
FIG. 23 is a fragmentary front view of the pusher mechanism, illustrating the manner in which it is maintained in its up position.

The baseplate pusher mechanism is normally maintained in a position shown in FIG. 8 in which the baseplate 34 is in its up position. When the cassette feed mode is established, the mechanism is maintained in this mode, and as the drum 12 rotates, the operating cam 54 operates through the cam follower 55 to oscillate the rockable lever 57 between the solid line position and the phantom line position shown in FIG. 8 while the pulling lever 59, pivotally connected with one end of the lever 57, only undergoes a vertical movement. Specifically, as the cam 54 rotates, the rockable lever 57 acts through the pulling lever 59 to raise the support lever 44 and thereafter oscillate to the phantom line position shown in FIGS. 8 and 23 under the resilience of the spring 58. During the rotation of the operating cam 54, the pulling lever 59 undergoes only a vertical movement between the solid line and the phantom line positions shown in FIG. 23 with its tab 59*b* maintained in abutment against the first arm 62*a* of the control lever 62, and causes no oscillating movement of the support lever 44.

Figure 21:
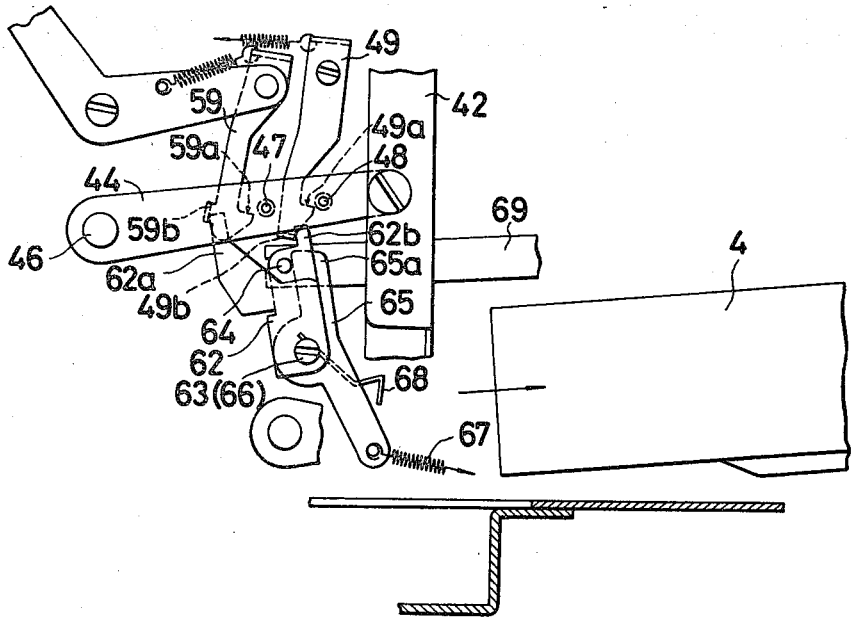
FIG. 21 is a fragmentary perspective view of the pusher mechanism immediately after the cassette is withdrawn.

The operation of the mechanism when the cassette 4 is removed, with its baseplate raised to its upper position, will now be described. When the cassette 4 is withdrawn to the right while the baseplate 34 is in its upper position as shown in FIG. 8, the cassette detecing lever 68 which has been urged by the front plate 4*d* (see FIG. 22) rocks counterclockwise under the resilience of the spring 67 (see FIG. 21). Simultaneously the release lever 65 rocks in the same direction, with its one end engaging the pin 64 to urge the control lever 62 counterclockwise as shown in FIG. 21. The resulting movement of the control lever 62 results in the engagement between its second arm 62*b* and the tab 49*b* of the holding lever 49 to rock the lever 49 clockwise to thereby disengage the step 49*a* from the pin 48, and also results in the engagement between its first arm 62*a* and the tab 59*b* of the pulling lever 59 to rock the lever 59 clockwise to thereby prevent the engagement between the step 59*a* and the pin 47. FIG. 21 shows the parts immediately after the cassette 4 is withdrawn. Subsequently, the baseplate pusher mechanism ceases to hold the holding lever 49, and moves down as shown in FIG. 20.

Specifically, when released from its upper position in which it has been maintained by the holding lever 49, the support lever 44 rocks downward by weight of the baseplate pusher link 42, whereby the link 42 also moves down to rock the pusher lever 35 clockwise through the lever 39 and the support shaft 38, thus moving the baseplate (see FIG. 8) down. The downward movement of the pusher lever 35 occurs substantially at the same time with the initial phase of the withdrawal of the cassette 4 from the holder 32 (see FIG. 6) or the disengagement of the cassette front plate 4*d* from the cassette detecting lever 68, so that the lever 35 is already in its down position shown in FIG. 20 when the cassette is withdrawn, presenting no interference with the withdrawal of the cassette. Also, the switch SW1 which detects the down position of the baseplate pusher mechanism is operated by the lower edge 44*b* of the support lever 44 (see FIG. 20).

The manual feed mode will now be described. In this instance, the copying machine may be in one of two conditions, namely when the cassette is loaded and when it is not loaded. When the cassette is not loaded, the pusher lever 35 does not move upward as mentioned previously. However, if the cassette is loaded and the manual feed takes place while the baseplate is in its upper position, a sheet will will also be fed from the cassette, which is not desirable. Therefore, it is necessary to give a priority to the manual feed under this condition. Also, when the cassette is not loaded, or in other words when the baseplate pusher mechanism is in its lower position and the switch SW1 is operated, no copying operation can take place. Thus, it is necessary to disable switch SW1 in the manual feed mode.

Figure 24:
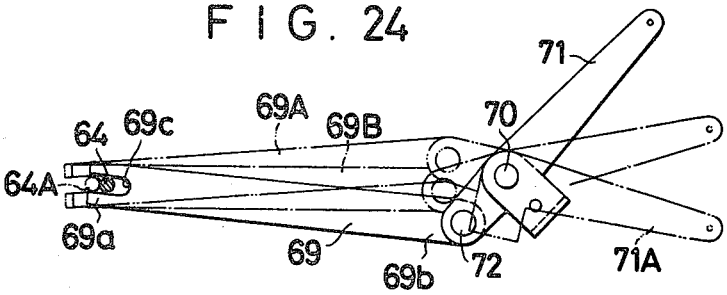
FIG. 24 is a front view of a feed mode switching lever, illustrating its different positions.

When a manual feed is desired, the cover 5 is turned to open the inlet 6 as shown in FIGS. 2 and 17, and the feed mode switching lever 71 is moved from the cassette feed mode position shown in solid line to the manual feed mode shown in double dot phantom line 71A in FIG. 8. Referring to FIG. 24, when the lever 71 is angularly moved about shaft 70, pin 72 mounted on its one end bears against the actuator SW2a of the manual mode detecting switch SW2 (see FIGS. 6 and 8), thus actuating this switch. The actuation of the switch SW2 provides an indication on a suitable location on the copying machine that the paper feeding apparatus is switched to the manual feed mode, and also disables the switch SW1. It also disables a copy counter if a repeated copying operation is being effected during the cassette feed mode. When the lever 71 is switched to its manual feed position shown by phantom line 71A, the forked end 69*a* of the link 69 which is pivotally connected therewith reciprocates in the lateral direction, as viewed in FIG. 24. During the forward stroke of the link 69, the bottom 69*c* of the forked end 69*a* moves the pin 64 on the control lever 62 from its solid line position to its release position shown by phantom line 64A. After going through the forward stroke from the solid line position 69 to a single dot phantom line position 69B, the link 69 returns as the lever 71 rocks until the manual feed mode position indicated by double dot phantom line 69A is reached. Switching lever 71 is maintained in respective mode positions by a movement of spring 74 (see FIGS. 6 and 8) beyond its dead center.

Figure 25:
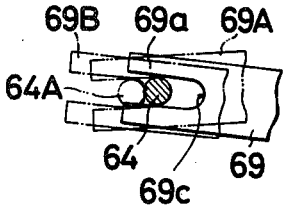
FIG. 25 is a fragmentary, enlarged front elevation of the switching lever.

As the link 69 moves, the control lever 62 rocks as indicated in FIG. 21, whereby the first and second arms 62*a*, 62*b* move the pulling lever 59 and holding lever 49, respectively, against their respective biases. When the cassette is loaded and the pusher mechanism is in its upper position, the control lever 62 disengages the levers 59, 49 from the pins 47, 48 to lower the mechanism, and its arms 62*a*, 62*b* move the levers 59, 49 to respective positions in which neither of the levers can engage the respective pins 47, 48. When the cassette is not loaded, the levers 59, 49 are already driven by the control lever 62 to respective positions shown in FIG. 20 in which they cannot engage the pins 47, 48, thus blocking a cassette feed operation with the combination of the control lever 62 and the link 69. The levers 59, 49 are maintained, in their positions to which they have been driven, by the abutment of the bottom 69*c* of the forked end 69*a* of the link 69 against the pin 64 on the control lever 62. When the cassette is not loaded, these positions of the levers are also maintained by the action of the release lever 65 which is urged by the spring 67. The length of the stroke through which the link 69 moves relative to the pin 64 in order to disable the baseplate pusher mechanism or the cassette feed mechanism is small, but is shown exaggerated in FIGS. 24 and 25.

Considering now the operation of the manual feed rollers 27, their rotation is controlled by the rotation control means associated with the cassette feed rollers 26. Referring to FIG. 13, when the print button is depressed to rotate the timing drum 85 and the pin 86 thereon rocks the detecting lever 103, the one-revolution clutch 95 is released. The rotation of the clutch 95 is transmitted through gear 92, idler 97 and gear 89 to rotate the cassette feed rollers 26, and is also transmitted through gears 93, 90 to rotate the manual feed rollers 27 (see FIGS. 12, 15 and 16).

Figure 18:
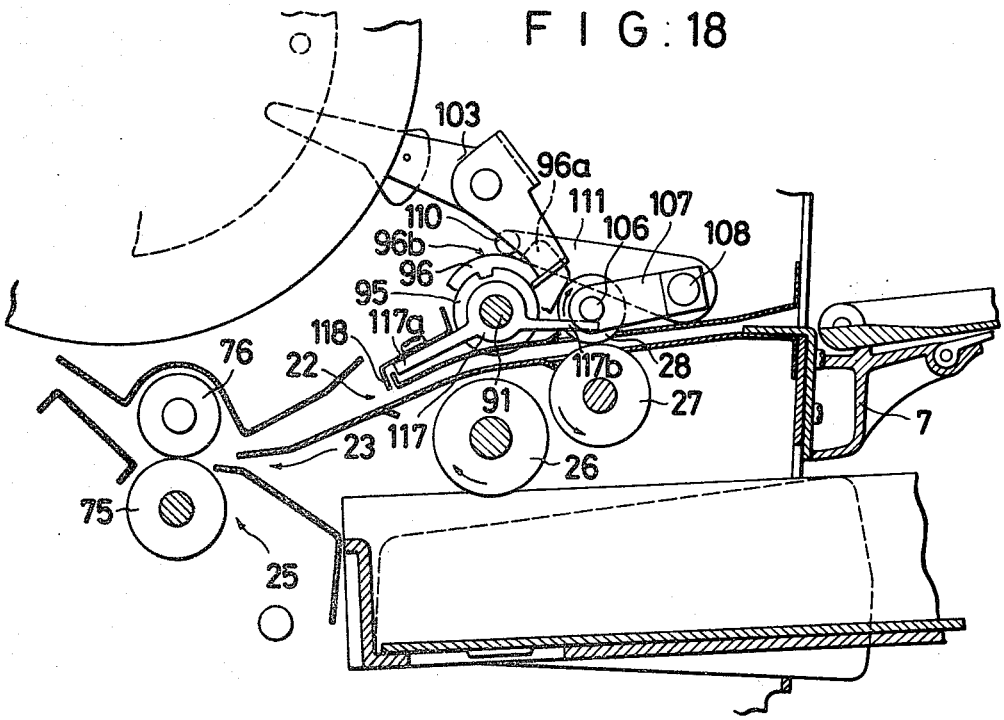
FIG. 18 is a view similar to FIG. 17 illustrating the operation of the manual feeder.

As the clutch 95 rotates, the cam 96 which is substantially integral therewith also rotates to rock the lever 111. As mentioned previously, the combination of the cam 96 and lever 111 controls the rotation of the roller pair 25, and also controls the movement of the idlers 28 toward or away from the manual feed rollers 27. As indicated in FIG. 17, when the cam follower 110 moves down from the portion 96*a* to the portion 96*b* of the cam 96 as shown in FIG. 18, the lever 111 rocks counterclockwise, as viewed in FIG. 18, under the resilience of the spring 112 (see FIG. 13). This results in a rocking motion of the pair of arms 107, which are integral with the support shaft 108 therefor, in the same direction, and the idlers 28 mounted thereon are urged by the leaf spring 109 (see FIG. 16). The idlers 28 rotate by abutment against the manual feed rollers 27.

As the arms 107 rock, the pin 106 engages one end 117*b* of the stop support 117 causing it to rotate clockwise about the shaft 91 against the bias applied by its own weight, whereby the sheet stop 118 mounted on the other end 117*a* moves away from the manual feed path 22 (see FIG. 18). After one revolution of the clutch 95, the cam follower 110 again engages the portion 96*a*, whereby the lever 111 rocks to rotate the support shaft 108 and the arms 107, thus freeing the bias upon the sheet stop supports 117. In this manner, the idlers 28 are moved away from the rollers 27 while the sheet stop 118 moves into the path 22. It will be understood that the manual feeder is operated concurrently with the cassette feeder.

When a manual feed is desired, the feed mode switching lever 71 is thrown to the manual mode position, shown at 71A in FIG. 8, and then the cover 5 is opened to insert a sheet or sheets of a given size into the path 22 through the inlet 6. The sheet or sheets, not shown, is or are positioned in abutment against the sheet stop 119 which is located to intercept the path 22 as shown in FIG. 17. Subsequently, the print button may be depressed to rotate the drum 12 and the timing drum 85 (see FIG. 15), whereby pin 86 rocks the detecting lever 103. This releases the one-revolution clutch 95, which acts through cam 96 and lever 111 to rock the idlers 28 to retract the sheet stop 118 from the path 22. As the idlers 28 move down to urge the sheet against the manual feed rollers 27, the sheet is conveyed by both of the rollers to the left on the path 22, as viewed in FIG. 18, and stops upon abutment against the roller pair 25. At this time, the sheet is flexed slightly, and hence can be resiliently fed into the nip between the roller pair 25 by virtue of the rigidity of the sheet material. The roller pair 25 begins to rotate after one revolution of the clutch 95 while the manual feed roller 27 remains stationary. The flexure in the sheet is produced by a choice of a sheet feed length given by the roller 27 which is slightly greater than the distance between the sheet stop 118 and the roller pair 25, which distance is chosen to be equal to the distance between the roller pair 25 and the leading edge of a sheet contained in the cassette when it is properly loaded.

The rotation of the roller pair 25 is started again when the lever 111 is rocked by the cam 96 to cause the detent lever 113 to release the one-way clutch 78 through the linkage. The idlers 28 move away from the feed rollers 27 at a timing which is slightly later than the initiation of rotation of the roller pair 25 as a result of the fact that the shaft on which the idlers 28 are mounted is supported in the elongate slot 107*a* formed in the arm 107 (see FIG. 16).

Figure 26:
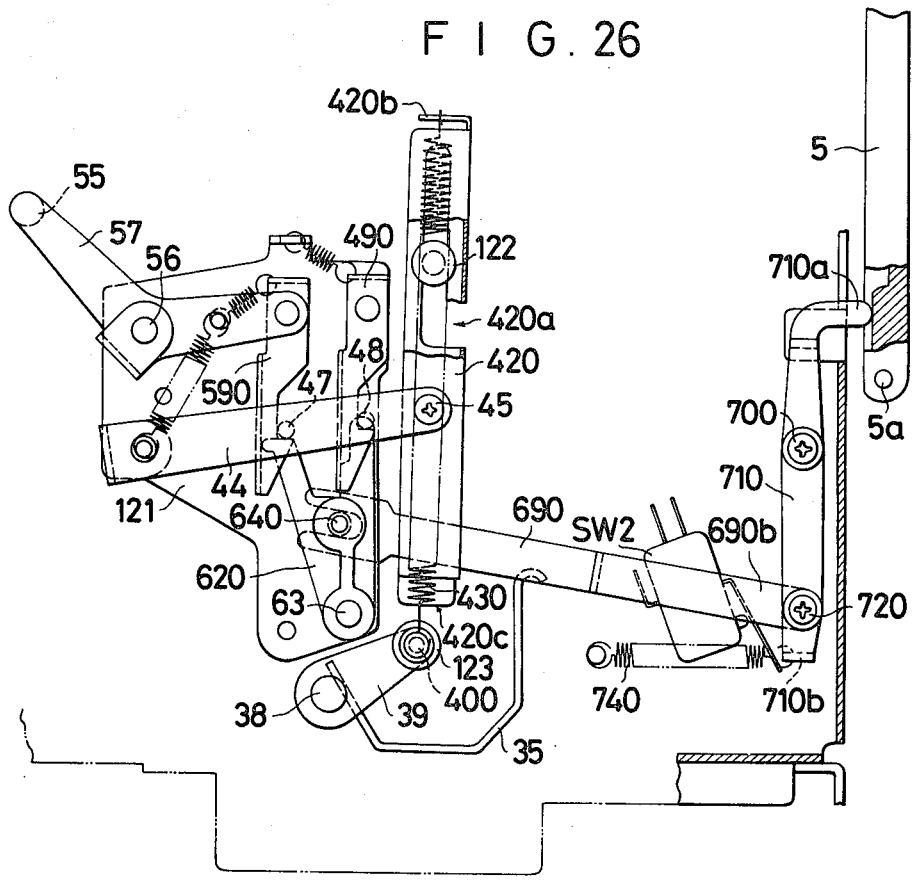
FIG. 26 is a fragmentary front view of another embodiment of the invention.
Figure 27:
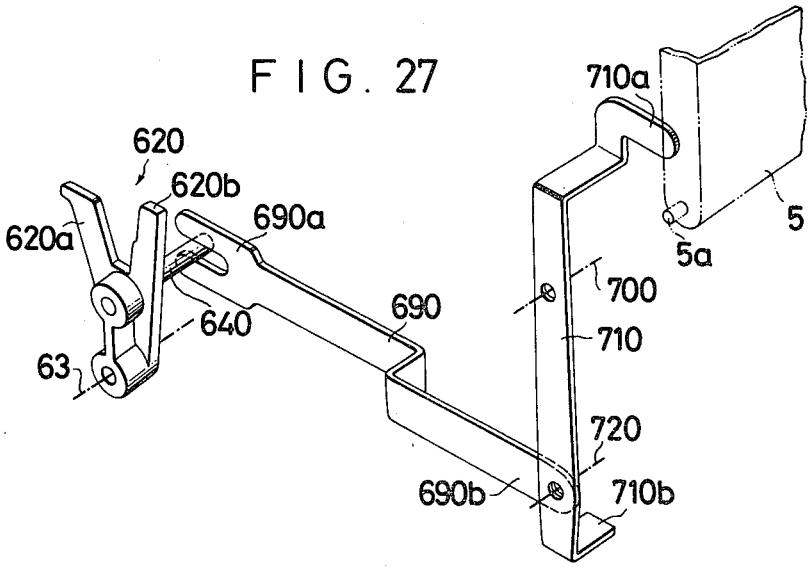
FIG. 27 is a fragmentary perspective view of the embodiment shown in FIG. 26.

In use of the manual feeder described above, the cassette feeder is disabled to enable the manual feeding operation by operating the feed mode switching lever and opening the cover which serves as the sheet guide. However, both of these operations can be achieved in one operation, by providing an arrangement in which the manual feed mode is automatically established as the cover is opened. Such arrangement is shown in FIGS. 26 and 27, which also illustrate a modification of the baseplate pusher mechanism. It is to be noted that corresponding parts are designated by like reference characters as before.

Rockable lever 57, holding lever 490, support lever 44 and control lever 620 are pivotally mounted on a support plate 121. A baseplate pusher link 420 is pivotally connected with the pin 45 which is fixedly mounted on the free end of the support lever 44. The link 420 is formed with a guide slot 420*a* in which a headed pin 122 fixedly mounted on the side plate 41 (see FIG. 9) is loosely fitted, thus allowing a vertical movement of the link 420. A spring 430, which serves to bias the baseplate, extends between the upper end 420*b* of the link and a pin 400 fixedly mounted on one end of the lever 39. A roller 123 is journaled on the pin 400 and is located adjacent the lower end 420*c* of the link. A forked end 690*a* of a link 690 is loosely fitted on a pin 640 which is mounted on the control lever 620.

Figure 28:
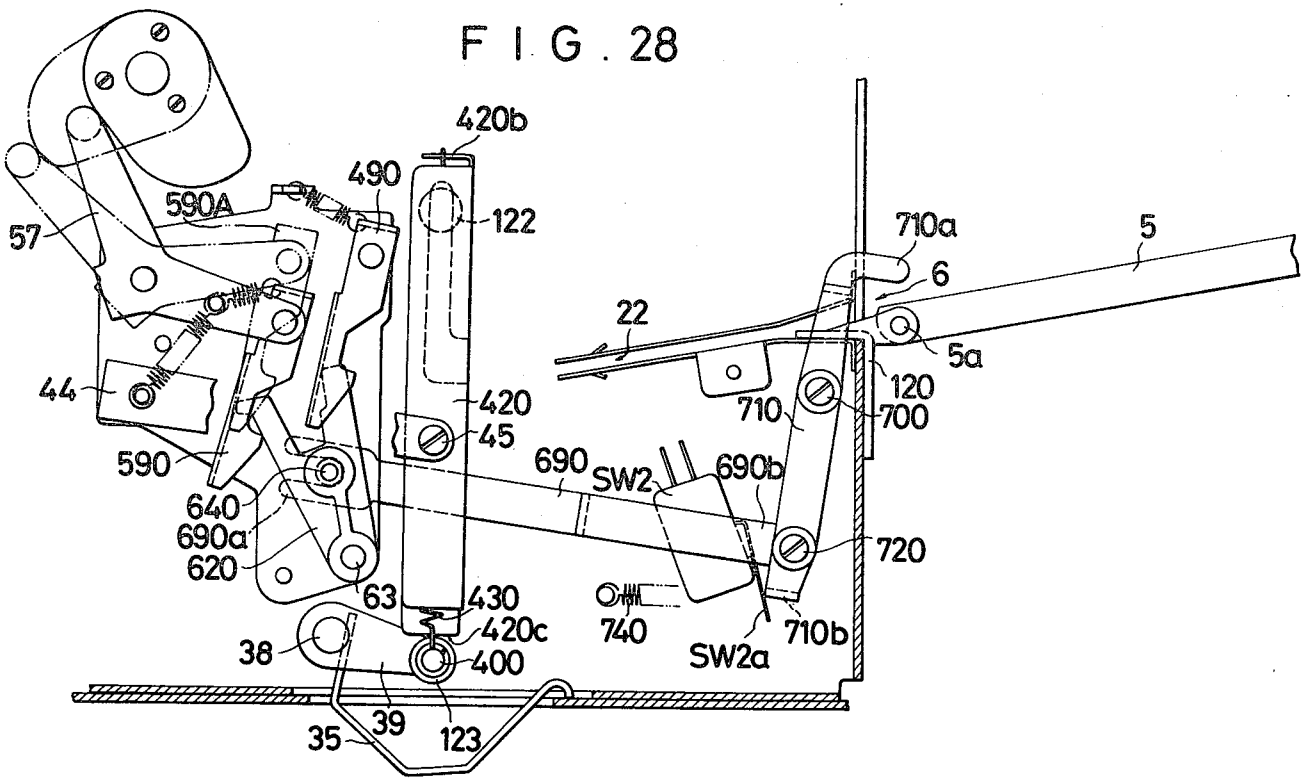
FIG. 28 illustrates the operation of the embodiment shown in FIG. 26.

A feed mode switching lever 710 is pivotally mounted at 700 on the side plate and carries a pin 720 on its one end on which one end 690*b* of the link 690 is mounted. The lever 710 has its other end 710*a* bent to project outside the machine at a position adjacent the inlet 6 (see FIG. 4). The end 710*b* of the lever 710 is folded in a direction perpendicular to the sheet of drawing of FIG. 26 and forms an actuator for the manual feed detecting switch SW2. A spring 740 is engaged with the lever 710 to urge it to rotate about the pin 700 in a direction in which the end 710*a* is urged into abutment against the cover 5. As a consequence, the link 690 is urged to move counterclockwise or in a direction in which it renders the baseplate pusher mechanism inoperative. The resulting movement of the lever 710 and the link 690 under such bias is limited by the abutment of the end 710*a* against the cover 5 (see FIG. 26). When the cover 5 is opened as shown in FIG. 28, such limitation is removed, establishing the manual feed mode in which the baseplate pusher mechanism or the cassette feeder is rendered inoperative. It is to be understood that FIG. 26 shows the baseplate pusher mechanism when a cassette, not shown, is loaded even though the release lever and the cassette detecting lever are not shown. As in the previous embodiment, the mechanism is rendered inoperative when the cassette is withdrawn.

Considering the condition illustrated in FIG. 26, if a manual feed is desired, the cover 5 is turned clockwise about pin 5*a* until it bears against the stop 7 (see FIG. 17). This brings the cover to the position shown in FIG. 28. The switching lever 710 rotates clockwise under the resilience of the spring 740, whereby the end 710*b* operates on the actuator SW2*a* of the switch SW2. The link 690 is then effective to push the pin 640 with its forked end 690*a*, thus rocking the control lever 620 to render the baseplate pusher mechanism inoperative.

As the control lever 620 rocks, the pulling lever 590 and holding lever 490 are displaced to and maintained in positions where they cannot engage with the support lever 44. When disengaged from the holding lever 490, the support lever 44 moves down to actuate the baseplate down detecting switch SW1 (see FIG. 8), but the switch SW2 has a priority over this switch. As the support lever 44 moves down, the link 420 also moves down, with its lower end 420*c* abutting against the roller 123 to rock the pusher lever 35. Subsequently, a sheet or sheets are inserted into the path 22 as mentioned previously.

From the above description, it will be understood that this embodiment of the invention comprises single feed control means which simultaneously controls the manual and the cassette feeder, means for disabling the cassette feeder when a manual feed mode is established, and release means for releasing the disable means when a manual feed is disabled. The single feed control means simplifies the general arrangement. When the manual feed mode is established, the manual feed operation is given the priority over the cassette feeder which is then disabled. On the contrary, when the manual feed operation is disabled, or when the feed mode switching lever or the cover is operated to allow the cassette feed operation, the cassette feeder is released from its disabled condition. In this manner, either one of the feed operations is only possible during each feed mode even though the respective feeders are operative, thus preventing an inadvertent operation. In other words, a manual feed and a cassette feed operation cannot take place simultaneously. When the manual feed operation is disabled as by closing the cover, the cassette feeder is automatically enabled, thus conveniently avoiding the need for a switching to the cassette feed mode.

In the above embodiment, means which disables the cassette feeder when the cassette feed mode is established operates to prevent an upward movement of the baseplate pusher mechanism. However, such disable means may be replaced by an arrangement in which the cassette feed roller 26 is made movable toward or away from the cassette so that it moves away therefrom when the manual feed mode is established, thus preventing a sheet contained within the cassette from being fed even if the baseplate is driven upward. Alternatively, an arrangement can also be made in which the transmission of the rotation to the feed roller 26 is interrupted even if the baseplate is in its up position and the roller is in abutment against the uppermost sheet, as by disposing the idler 97 shown in FIG. 12 to be engageable with and disengageable from the gears 89, 92. Obviously, such disable means is effective during the manual feed mode, but is released whenever the cassette feed mode is established.

Figure 29:
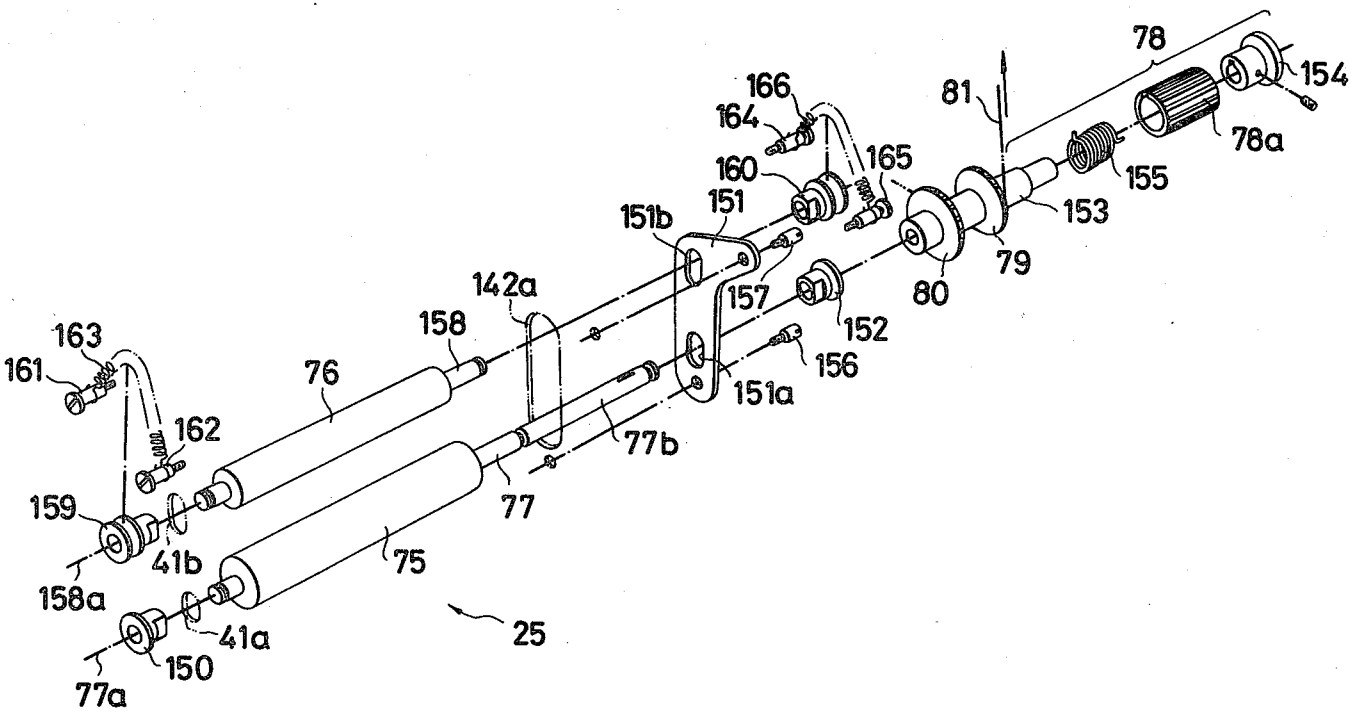
FIG. 29 is an exploded perspective view of a registering roller pair.

Referring to FIG. 29, a remedy for the jamming of a sheet around the roller pair 25 or the replacement thereof for purpose of inspection will now be described. When an inspection of the roller pair 25 is desired, the springs 163, 166 which urge the idler 76 against the registering roller 75 are removed, and then screws 156, 157 are unscrewed to remove the support plate 151 from the side plate 142. Subsequently, the idler 76 and the registering roller 75 are withdrawn through the opening 142*a*. Obviously, chains 81, 102 which extend around the sprockets 79, 80 are loosened and removed in a suitable manner. The replacement of the roller pair 25 takes place by an opposite procedure. In this manner, the maintenance of the roller pair is greatly facilitated.

The operation of the paper detector will now be described. Referring to FIG. 20, when the baseplate pusher mechanism is in its down position, the lower edge of the support lever 44 operates the switch SW1, which thus produces a baseplate down signal. At this time, the detecting switch SW3 located adjacent the cassette feed roller 26 has its actuator SW3*a* located so as to produce a paper absent signal, but the effect of the switch SW3 is disabled by the baseplate down signal from the switch SW1, thus overriding the paper absent signal to allow the initiation of a copying operation. Thus, the print button can be depressed to rotate the drum, whereupon the baseplate pusher mechanism is operated to raise the baseplate 34 as shown in FIG. 8 if the cassette is properly loaded. When the baseplate pusher mechanism is maintained in its up position, the switch SW1 is rendered inoperative, enabling the switch SW3.

When a sheet or sheets are contained in the cassette, the detecting switch SW3 does not produce a paper absent signal since its actuator SW3*a* is rocked by the uppermost sheet as shown in FIG. 22. However, when the cassette does not contain a sheet, the acutator SW3*a* cannot be operated if the baseplate 34 is raised, so that the switch SW3 produces a paper absent signal. It is to be noted that the baseplate 34 is formed with a recess or opening 34*a* in which the actuator SW3*a* is fitted.

During the manual feed mode, the baseplate pusher mechanism is maintained in its down position to operate the switch SW1, which disables the detecting switch SW3, thus avoiding an influence upon the initiation of a copying operation.

To summarize, the paper detector is constructed so that, during the manual feed mode, the baseplate down detecting switch disables the paper detecting switch to thereby prevent the issuance of a paper absent signal if the baseplate is in its down position as it may assume immediately after the cassette is loaded. However, the paper detecting switch is given a priority over the baseplate down detecting switch to permit the issuance of a paper detecting signal whenever the baseplate is in its up position. As a consequence, a paper absent signal cannot be produced during the manual mode and when the baseplate has not reached its up position as it occurs immediately after the loading of the cassette.

It is to be noted that, at the time the paper absent signal is generated, the drum has undergone at least the charging step though partly. Since the drum surface is charged by the charging step, the deposition of a toner onto the entire charged area will occur when toner is supplied from the developer 15. To cater for this difficulty, when the paper absent signal is generated, the charger 13, lamp 20 and developer 15 can be momentarily disabled while activating the charge cleaning step, thus removing a partial deposition of the toner.

While specific embodiments of the invention have been shown and described in detail to illustrate the application of the principles of the invention, it will be understood that the invention may be embodied otherwise without departing from such principles.

What is claimed is:

1. Paper feeding apparatus for copying machines, comprising a path along which a manually loaded sheet of paper is conveyed, a cassette feed path along which a sheet from a cassette is conveyed, a manual feeder operable to feed a sheet which is placed on the manual feed path in a given direction, a cassette feeder operable to feed sheets contained in a sheet cassette one by one onto the cassette feed path, single feed control means responsive to a single feed signal to operate the manual feeder and the cassette feeder simultaneously, and feed mode switching means operable to selectively establish a manual feed mode and a cassette feed mode.

2. Paper feeding apparatus according to claim 1 in which the manual feeder includes a manual feed roller disposed on the manual feed path, an idler movable toward or away from the manual feed roller, means carrying the idler so as to be movable toward or away from the manual feed roller and normally urging it toward the manual feed roller, and a sheet stop disposed in a displaceable manner with respect to the manual feed path.

3. Paper feeding apparatus according to claim 2 including mounting means having a slot, and a shaft loosely mounted in the slot and mounting the idler, the slot being elongated in a direction to provide for movement of the idler toward and away from the manual feed roller.

4. Paper feeding apparatus according to claim 3 including means normally biasing the idler in a direction to abut against the manual feed roller.

5. Paper feeding apparatus according to claim 2 in which the idler is moved toward or away from the manual feed roller is accordance with the operation of the feed control means.

6. Paper feeding apparatus according to claim 2 in which the sheet stop is retracted from the manual feed path as the idler moves toward the manual feed roller and moves into the manual feed path as the idler moves away from the manual feed roller.

7. Paper feeding apparatus according to claim 2 including means urging the sheet stop to move into the manual feed path.

8. Paper feeding apparatus according to claim 1 in which the cassette feeder includes a fixedly positioned cassette feed roller, a sheet cassette including a vertically movable baseplate on which sheets are placed, a baseplate pusher mechanism operable to raise the baseplate to bring an uppermost sheet into abutment against the cassette feed roller, and pressure control means associated with the baseplate pusher mechanism.

9. Paper feeding apparatus according to claim 8 in which the cassette feeder includes a baseplate pusher mechanism operable to raise the baseplate of sheet cassette, and a switch operable to detect the operative and the inoperative positions of the baseplate pusher mechanism.

10. Paper feeding apparatus according to claim 9 including a pusher lever movable into abutment against or away from the baseplate of a sheet cassette, a pusher linkage urging the pusher lever in a direction to raise the baseplate, and a rockable support lever forming part of the linkage, said rockable support lever being effective to operate the detecting switch.

11. Paper feeding apparatus according to claim 8, in which the baseplate pusher mechanism comprises a baseplate pusher lever movable into abutment against or away from the baseplate of a sheet cassette, a pusher linkage urging the pusher lever in a direction to raise the baseplate, a pulling lever operable to pull the linkage from a baseplate down position to a baseplate up position, a holding lever operable to hold the linkage in the baseplate up position, a rotating mechanism, means associated with the rotating mechanism and operable to operate the pulling lever, and control means responsive to the presence or abaence of a loaded sheet cassette controlling the engagement between the baseplate pusher linkage, on one hand, and the pulling and holding levers, on the other.

12. Paper feeding apparatus according to claim 11 in biasing the pusher linkage includes a spring which the baseplate pusher lever in a direction to raise the baseplate.

13. Paper feeding apparatus according to claim 11 in which the rotating mechanism comprises a photosensitive member in the form of a drum.

14. Paper feeding apparatus according to claim 11 in which the control means comprises a control lever having a first and a second arm which are engageable with and disengageable from the pulling and the holding lever, respectively, a release lever urging the control lever to disengage both levers from the linkage, and a cassette detecting lever for detecting the presence or absence of a loaded sheet cassette.

15. Paper feeding apparatus according to claim 11 including a photosensitive member in the form of a drum, said means for operating the pulling lever comprising an operating cam substantially integral with said photosensitive member, and a rockable lever pivotally mounted on the pulling lever at one end and having its opposite end positioned to cooperate with the cam.

16. Paper feeding apparatus according to claim 8 in which the pressure control means comprises a baseplate pusher lever movable into abutment against or away from the baseplate of a sheet cassette, a baseplate pusher linkage urging the pusher lever in a direction to raise the baseplate, a pulling lever operable to pull the linkage from a baseplate down position to a baseplate up position, a holding lever operable to hold the linkage in the baseplate up position, a cassette detecting lever operable to detect the presence or absence of a loaded sheet cassette, a control lever operable to disable the engagement between the linkage and the pulling lever when a sheet cassette is loaded and the baseplate is in its up position and to provide for engagement between the linkage and the pulling and holding levers when a sheet cassette is not loaded and during a manual feed mode, and a release lever substantially integral with the cassette detecting lever and operable to cause the control lever to provide for said engagement when a sheet cassette is not loaded.

17. Paper feeding apparatus according to claim 8 in which the feed mode switching means includes a plurality of levers operable to selectively maintain the baseplate pusher mechanism of the cassette feeder in operative and inoperative positions.

18. Paper feeding apparatus according to claim 17, in which said plurality of levers includes a control lever controlling the operation of the linkage of the cassette feeder, a link operable to rock the control lever, and an operating lever operable to move the link.

19. Paper feeding apparatus according to claim 1 in which the single feed control means comprises a drive source, a single one-revolution clutch connected with the drive source and operable to transmit or interrupt the drive from the source to the manual feed roller and the cassette feed roller simultaneously, a single feed signal source, a detecting lever disposed between the single feed signal source and the clutch and operable to control the operation of the clutch, and a cam substantially integral with the clutch.

20. Paper feeding apparatus according to claim 19 in which the single signal source comprises a timing drum which rotates through one revolution for a single copying operation.

21. Paper feeding apparatus according to claim 1, further comprising a registering mechanism disposed at a location where the manual feed path and the cassette feed path merge.

22. Paper feeding apparatus according to claim 21 in which the registering mechanism comprises a drive source, a registering roller connected with and driven by the drive source, an idler adapted to rotate in following relationship with the registering roller, and means controlling the rotation of the registering roller.

23. Paper feeding apparatus according to claim 1 in which the cassette feeder includes a cassette holder which detachably supports a sheet cassette.

24. Paper feeding apparatus according to claim 1 in which the cassette feeder includes a cassette feed roller, and a switch disposed adjacent the cassette feed roller and operable to detect the presence or absence of a sheet contained in the cassette.

25. Paper feeding apparatus according to claim 24 in which the cassette feeder includes a fixedly positioned cassette feed roller, a sheet cassette including a vertically movable baseplate on which sheets are placed, a baseplate pusher mechanism operable to raise the baseplate to bring an uppermost sheet into abutment against the cassette feed roller and a switch which detects the operative and inoperative positions and the baseplate pusher mechanism to detect a baseplate down position, the switch which detects the presence or absence of a sheet being disabled when the switch which detects the operative and inoperative positions of the baseplate detects a baseplate down position and being preferentially enabled, relative to the baseplate detecting switch, in the up position of the baseplate.

26. Paper feeding apparatus according to claim 1, further comprising a cover which opens or closes an inlet of the manual feed path, the cover also serving as part of the feed mode switching means.

27. Paper feeding apparatus according to claim 26 including means operable to establish a manual feed mode responsive to opening of the cover and to switch the mode to a cassette feed mode responsive to closing of the cover.

28. Paper feeding apparatus according to claim 27 in which the cover also serves as a sheet guide.

29. Paper feeding apparatus according to claim 1 in which the feed mode switching means includes a feed mode detecting switch.

30. Paper feeding apparatus according to claim 29 including a lever associated with the feed mode switching means, the feed mode detecting switch being operated in response to movement of such lever.

31. Paper feeding apparatus according to claim 29, in which the cassette feeder includes a fixedly positioned cassette feed roller, a sheet cassette including a vertically movable baseplate on which sheets are placed, a baseplate pusher mechanism operable to raise the baseplate to bring an uppermost sheet into abutment against the cassette feed roller, a switch disposed adjacent the cassette feed roller and operable to detect the presence or absence of a sheet contained in the cassette, and a switch operable to detect the operative and inoperative positions of the baseplate pusher mechanism, the feed mode detecting switch being preferentially operated and disabling the baseplate detecting switch and the paper detecting switch whenever the feed mode detecting switch detects a manual feed mode.

* * * * *